US010443600B2

(12) United States Patent
Kozaki et al.

(10) Patent No.: US 10,443,600 B2
(45) Date of Patent: Oct. 15, 2019

(54) GAS ESTIMATION DEVICE AND VACUUM PUMPING DEVICE

(71) Applicant: SHIMADZU CORPORATION, Kyoto (JP)

(72) Inventors: Junichiro Kozaki, Kyoto (JP); Masaya Nakamura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 16/132,389

(22) Filed: Sep. 15, 2018

(65) Prior Publication Data

US 2019/0107110 A1 Apr. 11, 2019

(30) Foreign Application Priority Data

Oct. 6, 2017 (JP) ..... 2017-196223

(51) Int. Cl.

| | |
|---|---|
| ***F04D 15/00*** | (2006.01) |
| ***F04D 17/16*** | (2006.01) |
| ***F04D 19/04*** | (2006.01) |
| ***F04D 27/00*** | (2006.01) |
| *F04D 3/00* | (2006.01) |

(52) U.S. Cl.
CPC ..... *F04D 15/0022* (2013.01); *F04D 17/168* (2013.01); *F04D 19/04* (2013.01); *F04D 27/001* (2013.01); *F04D 3/005* (2013.01)

(58) Field of Classification Search
None
See application file for complete search history.

(56) References Cited

U.S. PATENT DOCUMENTS

| | | | | |
|---|---|---|---|---|
| 5,865,205 | A * | 2/1999 | Wilmer | G05D 7/0635 137/2 |
| 7,174,777 | B2 * | 2/2007 | Fischer | F02B 37/013 73/114.33 |
| 7,380,564 | B2 * | 6/2008 | Lull | G01F 25/0007 118/715 |
| 7,680,563 | B2 * | 3/2010 | Kofuji | G05D 16/2073 137/14 |
| 2003/0045961 | A1 * | 3/2003 | Nakao | H01L 21/67253 700/121 |

(Continued)

FOREIGN PATENT DOCUMENTS

JP 2014-093497 A 5/2014

*Primary Examiner* — Jason Lin
(74) *Attorney, Agent, or Firm* — Renner, Otto, Boisselle & Sklar, LLP

(57) ABSTRACT

A gas estimation device for estimating a flow rate and a gas type of gas to be vacuum-pumped by a vacuum pumping device including a vacuum pump and an automatic pressure control valve connected to a suction port of the vacuum pump, comprises: a correlation data storage section configured to store first correlation data containing correlation data regarding an opening degree control gain value of the automatic pressure control valve and correlation data regarding an effective exhaust velocity of the vacuum pumping device and second correlation data indicating a correlation among a flow rate, a gas type, and a motor current value in the vacuum pump; and a first estimation section configured to estimate the flow rate and the gas type of the gas to be vacuum-pumped by the vacuum pumping device based on at least the first correlation data and the second correlation data.

8 Claims, 21 Drawing Sheets

(56) References Cited

U.S. PATENT DOCUMENTS

| | | | | |
|---|---|---|---|---|
| 2005/0167398 | A1* | 8/2005 | Kitazawa | C23C 16/4412 216/59 |
| 2008/0183340 | A1* | 7/2008 | Kofuji | G05D 16/2073 700/301 |
| 2009/0250000 | A1* | 10/2009 | Kobayashi | H01L 21/67201 118/50 |
| 2013/0071258 | A1* | 3/2013 | Enomoto | F04B 49/10 417/44.1 |
| 2015/0234393 | A1* | 8/2015 | Kehoe | G01F 25/0007 137/2 |
| 2016/0252912 | A1* | 9/2016 | Horwitz | G05D 7/0635 137/2 |

* cited by examiner

INITIAL DATA UNIT GROUP GDU1

INITIAL DATA UNIT GROUP GDU2

INITIAL DATA UNIT GROUP GDU3

(Mest, Qest)=(Ma, Q0)

GAS ESTIMATION DEVICE AND VACUUM PUMPING DEVICE

BACKGROUND OF THE INVENTION

1. Technical Field

The present invention relates to a gas estimation device and a vacuum pumping device.

2. Background Art

In a vacuum device such as an etching device, a process is performed in a state in which process gas flows into a process chamber while an internal chamber pressure is maintained at a predetermined pressure. Thus, an automatic pressure control valve (also called an "APC valve") is provided between the process chamber and a vacuum pump, and the pressure of the process chamber is controlled to a desired pressure by the automatic pressure control valve (see, e.g., Patent Literature 1 (JP-A-2014-093497)).

In the case of exhausting of the process chamber by a vacuum pumping device including the vacuum pump and the automatic pressure control valve, exhaust characteristic data of the vacuum pumping device is stored in a controller of the automatic pressure control valve in advance, and pressure control operation by the automatic pressure control valve is performed based on the exhaust characteristic data.

However, the exhaust characteristic data stored in advance is typically based on standard gas (e.g., nitrogen gas and argon gas) different from the process gas used actually. The exhaust characteristic data also depends on a gas type. For this reason, there is a problem that pressure control cannot be performed with high accuracy when the gas type of gas to be exhausted is unknown.

SUMMARY OF THE INVENTION

A gas estimation device for estimating a flow rate and a gas type of gas to be vacuum-pumped by a vacuum pumping device including a vacuum pump and an automatic pressure control valve connected to a suction port of the vacuum pump, comprises: a correlation data storage section configured to store first correlation data containing correlation data regarding an opening degree control gain value of the automatic pressure control valve and correlation data regarding an effective exhaust velocity of the vacuum pumping device and second correlation data indicating a correlation among a flow rate, a gas type, and a motor current value in the vacuum pump; and a first estimation section configured to estimate the flow rate and the gas type of the gas to be vacuum-pumped by the vacuum pumping device based on at least the first correlation data and the second correlation data. The correlation data regarding the opening degree control gain value indicates a correlation among the opening degree control gain value, the gas type and the flow rate of the gas to be vacuum-pumped by the vacuum pumping device, and a valve opening degree of the automatic pressure control valve, the correlation data regarding the effective exhaust velocity indicates a correlation among the effective exhaust velocity, the gas type and the flow rate of the gas to be vacuum-pumped by the vacuum pumping device, and the valve opening degree of the automatic pressure control valve, and control correction information used for control of the automatic pressure control valve is output based on an estimation result of the first estimation section.

The first estimation section estimates the flow rate and the gas type of the gas to be vacuum-pumped by the vacuum pumping device based on the motor current value of the vacuum pump, the valve opening degree of the automatic pressure control valve, a pressure measurement value of a vacuum chamber vacuum-pumped by the vacuum pumping device, the first correlation data, and the second correlation data, and the estimation result of the first estimation section is output as the control correction information.

The gas estimation device further comprises: a second estimation section configured to estimate the flow rate and the gas type of the gas to be vacuum-pumped by the vacuum pumping device based on a pressure measurement value for each of multiple valve opening degrees upon gas exhausting with a predetermined flow rate, the multiple valve opening degrees, the motor current value of the vacuum pump, the first correlation data, and the second correlation data; and a calibration section configured to calibrate the first correlation data based on the gas type estimated by the second estimation section. Pre-calibration first correlation data stored in the correlation data storage section is replaced with the first correlation data calibrated by the calibration section.

The gas estimation device further comprises: a determination section configured to determine, based on the flow rate estimated by the second estimation section, whether or not a flow rate upon pressure measurement for each of the multiple valve opening degrees is the predetermined flow rate.

A vacuum pumping device comprises: the gas estimation device; a vacuum pump; and an automatic pressure control valve connected to a suction port side of the vacuum pump. The automatic pressure control valve includes an opening degree measurer configured to measure the valve opening degree, a gain value setting section configured to set a gain value of valve opening degree control upon pressure control based on the flow rate and the gas type estimated by the first estimation section, a valve opening degree measurement value, and the first correlation data stored in the correlation data storage section, and a valve opening degree control section configured to control the valve opening based on the set gain value and the pressure measurement value.

A vacuum pumping device comprises: the gas estimation device; a vacuum pump; and an automatic pressure control valve connected to a suction port side of the vacuum pump. The vacuum pump includes an allowable flow rate data storage section configured to store allowable flow rate data indicating a correlation between a gas type of gas to be exhausted by the vacuum pump and an allowable upper flow rate limit, and a pump control section configured to output warning information in a case where the flow rate estimated by the first estimation section is greater than the allowable upper flow rate limit acquired based on the allowable flow rate data and the gas type estimated by the first estimation section.

The first estimation section estimates the flow rate and the gas type of the gas to be vacuum-pumped by the vacuum pumping device based on a pressure measurement value for each of multiple valve opening degrees upon gas exhausting with a predetermined flow rate, the multiple valve opening degrees, the motor current value of the vacuum pump, the first correlation data, and the second correlation data, a calibration section configured to calibrate the first correlation data based on the gas type estimated by the first estimation section is further provided, and calibrated first correlation data calibrated by the calibration section is output as the control correction information.

A vacuum pumping device comprises: the gas estimation device; a vacuum pump; and an automatic pressure control valve connected to a suction port side of the vacuum pump. The automatic pressure control valve includes an opening degree measurer configured to measure the valve opening degree, a gain value setting section configured to set a gain value of valve opening degree control upon pressure control based on a preset gas type, a valve opening degree measurement value, and the calibrated first correlation data, and a valve opening degree control section configured to control the valve opening degree based on the set gain value and the pressure measurement value.

According to the present invention, control correction information based on at least the gas type is obtained, and therefore, the automatic pressure control valve can be controlled according to the gas type.

DETAILED DESCRIPTION OF THE EXEMPLARY EMBODIMENTS

Hereinafter, embodiments of the present invention will be described with reference to the drawings.

First Embodiment

Figure 1:
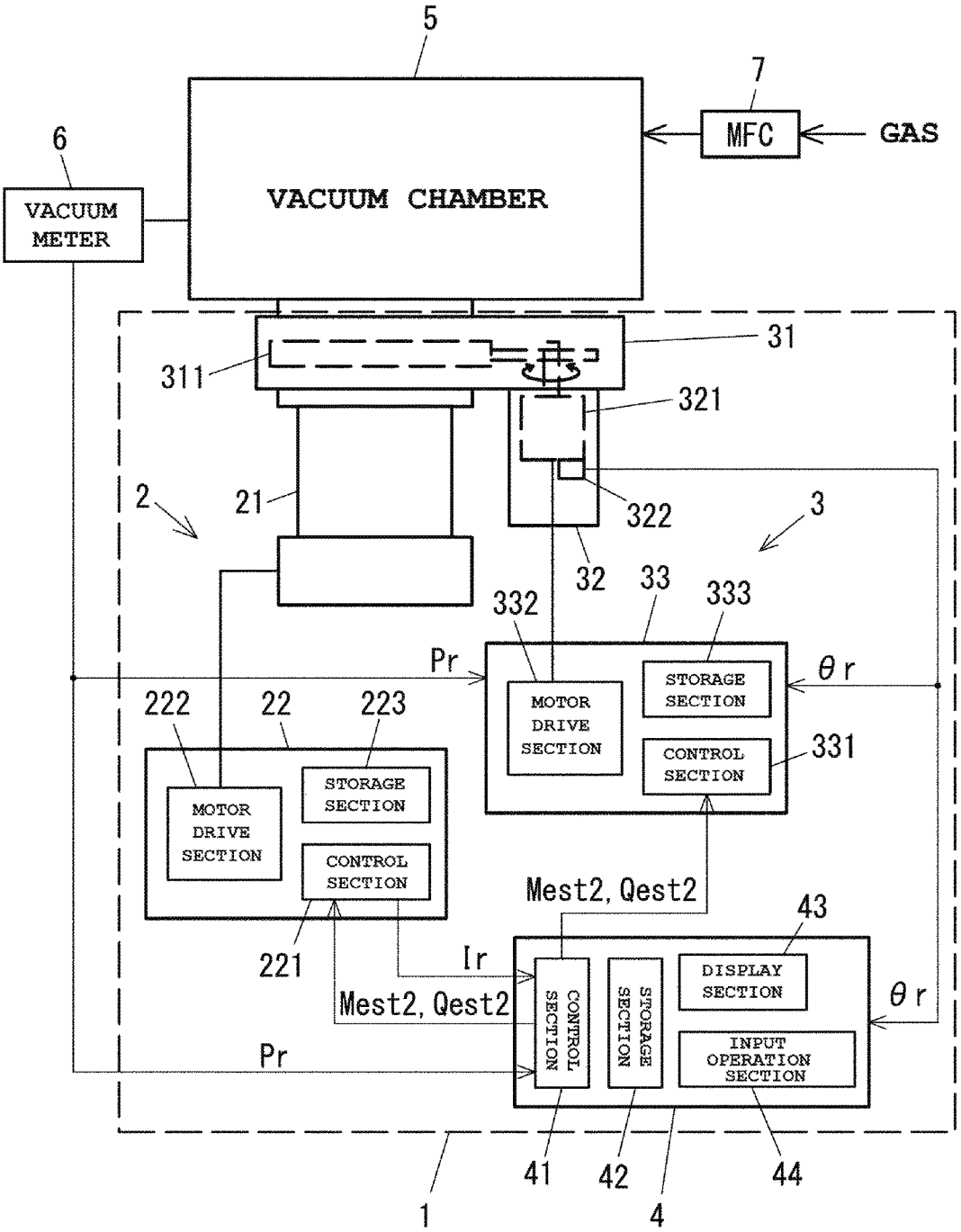
FIG. 1 is a view of one example of a vacuum pumping device.

FIG. 1 is a view of one example of a vacuum pumping device 1 according to the present invention. The vacuum pumping device 1 includes a turbo-molecular pump 2, an automatic pressure control value (hereinafter referred to as an "APC valve") 3, and a gas estimator 4. The turbo-molecular pump 2 includes a pump main body 21 and a pump controller 22 configured to drivably control the pump main body 21. The APC valve 3 includes a valve body 31 provided with a valve plate 311, a motor housing 32 provided with a motor 321 configured to drive the valve plate 311, a valve controller 33. Note that although not shown in the figure, a back pump is connected to an exhaust side of the pump main body 21.

A suction port flange of the pump main body 21 is fixed to a valve exhaust port (not shown) provided on a lower side of the valve body 31 as viewed in the figure, and a valve suction port (not shown) provided on an upper side of the valve body 31 as viewed in the figure is fixed to an exhaust port flange of a vacuum chamber 5. The vacuum chamber 5 is vacuum-pumped by the pump main body 21. The pressure of the vacuum chamber 5 is measured by a vacuum meter 6. Gas introduction into the vacuum chamber 5 is performed via a mass flow controller 7.

The pump controller 22 includes a control section 221, a motor drive section 222, and a storage section 223. The motor drive section 222 includes an inverter etc., and is configured to drive a pump rotor rotation motor (not shown) provided at the pump main body 21. For example, the control section 221 includes a field programmable gate array (FPGA), and is configured to control the motor drive section 222 and output a motor current value Ir to the gas estimator 4. The storage section 223 includes, for example, a ROM and a non-volatile memory, and is configured to store later-described allowable flow rate data Qmax etc.

The valve controller 33 includes a control section 331, a motor drive section 332 configured to drive the motor 321, and a storage section 333. The control section 331 configured to control the motor drive section 332 is configured to perform later-described valve opening degree control based on a pressure control estimation value (Mest2, Qest2) input from the gas estimator 4. The storage section 333 includes, for example, a ROM or a non-volatile memory, and is configured to store a later-described reciprocal sensitivity (1/Gp) etc. A pressure measurement value Pr from the vacuum meter 6 and the opening degree θr of the APC valve 3 measured by an encoder 322 are input to the valve controller 33.

The gas estimator 4 is a device configured to estimate a gas type, a flow rate, etc. as described later, and includes a control section 41, a storage section 42, a display section 43, and an input operation section 44. The motor current value Ir from the pump controller 22, the pressure measurement value Pr from the vacuum meter 6, and the opening degree θr of the APC valve 3 measured by the encoder 322 are input to the gas estimator 4.

Figure 2:
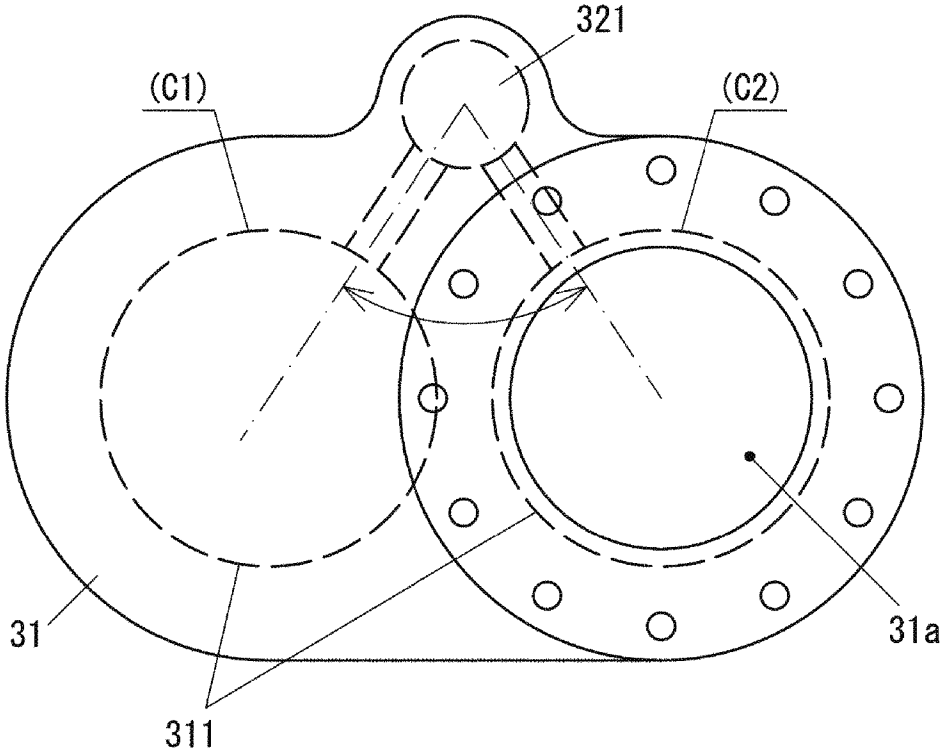
FIG. 2 is a plan view of a valve body.

FIG. 2 is a plan view of the valve body 31 from a vacuum chamber 5 side. When the motor 321 is rotatably driven in a forward direction and a reverse direction to swingably drive the valve plate 311, the valve plate 311 is slidably driven in the horizontal direction to perform valve opening/closing operation. The valve plate 311 can be slidably moved to an optional position between a fully-closed position C2 at which the valve plate 311 faces the entirety of a valve opening 31*a* and a fully-opened position C1 at which the valve plate 311 does not face the valve opening 31*a* at all.

The state of closing the valve opening 31*a* by the valve plate 311 is represented by a parameter called an opening degree. The opening degree is a ratio=(Swing Angle of Valve Plate):(Swing Angle until Valve Opening 31*a* is Fully Opened after Fully-Closed State) expressed in percentage. The fully-closed position C2 of FIG. 2 is the opening degree=0%, and the fully-opened position C1 is the opening degree=100%. That is, the opening degree of the valve plate 311 is adjusted to control the conductance of the APC valve 3. As described above, the opening degree θr of the valve plate 311 is detected by the encoder 322 provided at the motor housing 32 of FIG. 1.

(Pressure Control in APC Valve 3)

Figure 3:
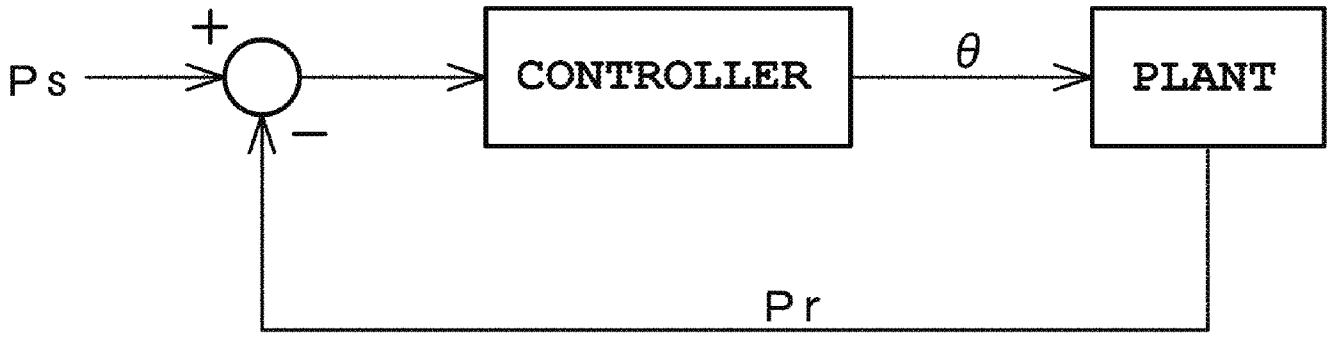
FIG. 3 is a diagram for describing a plant gain.

First, pressure control in the APC valve 3 will be described. A control system of the APC valve 3 is divided into a control target (PLANT) and a controller (CONTROLLER) as illustrated in FIG. 3. The chamber pressure as plant output is measured by the vacuum meter 6. This pressure measurement value Pr is fed back and controlled such that the chamber pressure reaches a target pressure value Ps. The plant illustrated in FIG. 3 is a gas exhaust section of the APC valve 3 taking the opening degree θ of the valve plate 311 as input and taking the pressure measurement value Pr as output. The controller of FIG. 3 is an actuator section including the valve controller 33 and the motor 321. Controller input is a deviation between the target pressure value Ps and the pressure measurement value Pr, and controller output is the opening degree θ detected by the encoder 322.

Figure 4:
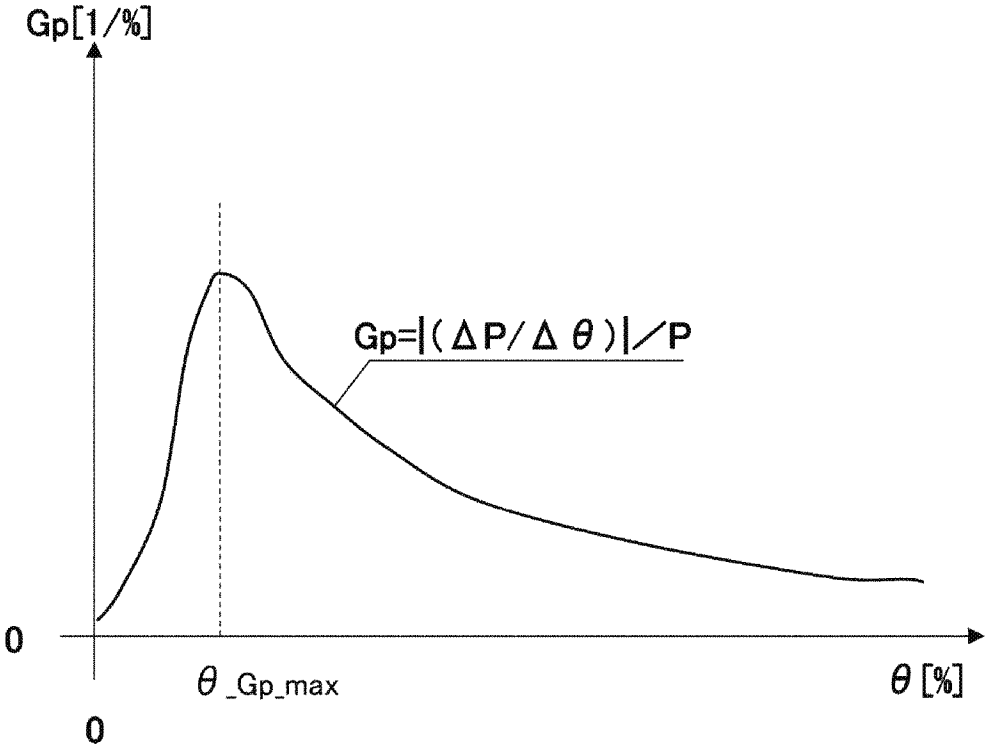
FIG. 4 is a graph of a characteristic curve of the plant gain.

Input/output characteristics of the plant illustrated in FIG. 3 are an amount ((ΔP/Δθ)/P) obtained in such a manner that a pressure change (ΔP/Δθ) in association with an opening degree change is normalized by a pressure P, and represent gain characteristics of the plant. Hereinafter, an absolute value |(ΔP/Δθ)|/P of (ΔP/Δθ)/P will be referred to as a "plant gain Gp." The plant gain Gp is represented by a characteristic curve as shown in FIG. 4. The plant gain Gp has the maximum value at an opening degree position (an opening degree θ_Gp_max) with a relatively-small opening degree θ. This shows that a pressure change significantly sensitively reacts to an opening degree change in the vicinity of the opening degree θ_Gp_max with the maximum value and is insensitive to an opening degree change in the vicinity (a range with a great opening degree θ) of a lower slope of a curve with a low value of the plant gain Gp.

Figure 5:
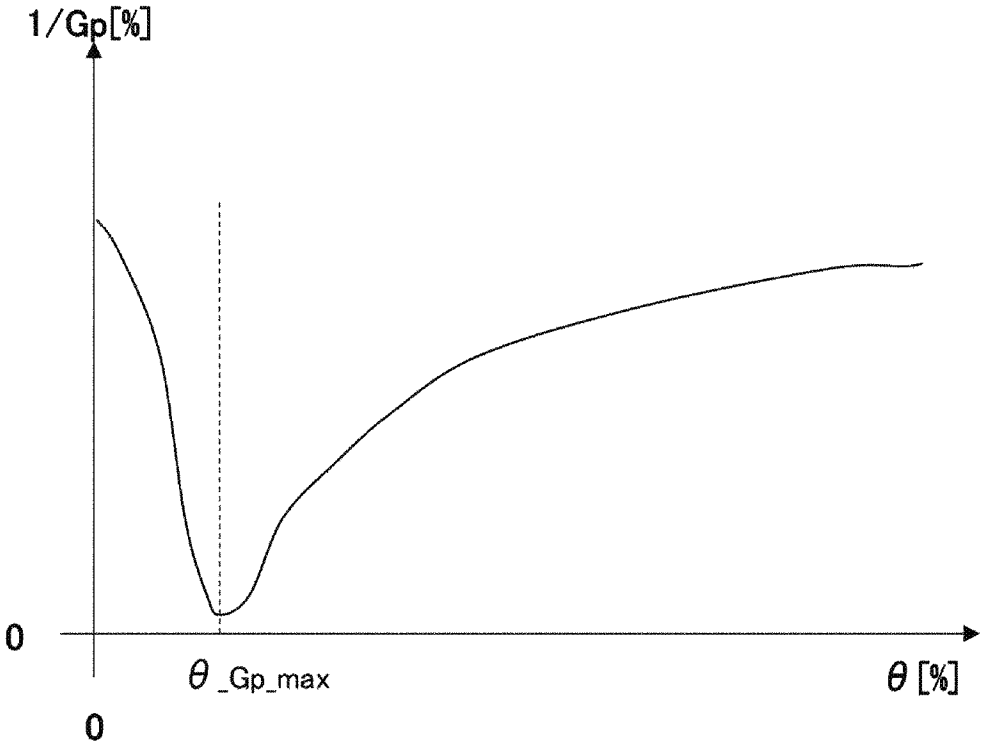
FIG. 5 is a graph of one example of a reciprocal sensitivity.

As described above, response sensitivity greatly varies according to an opening degree position, and therefore, it is difficult to perform drive control. For solving such a situation, the sensitivity value (1/Gp) corresponding to the reciprocal of the plant gain Gp is provided in advance to the controller of FIG. 3. Normally, the sensitivity value (1/Gp) is calculated and stored from later-described data acquired upon calibration. The sensitivity value (1/Gp) shows a characteristic curve as shown in FIG. 5. Hereinafter, the sensitivity value (1/Gp) will be referred to as "reciprocal sensitivity." By introduction of the reciprocal sensitivity (1/Gp), the biased gain characteristics of the plant are roughly cancelled, and uniform control is easily performed with a typical controller configuration such as a PI regardless of the opening degree position.

Figure 6:
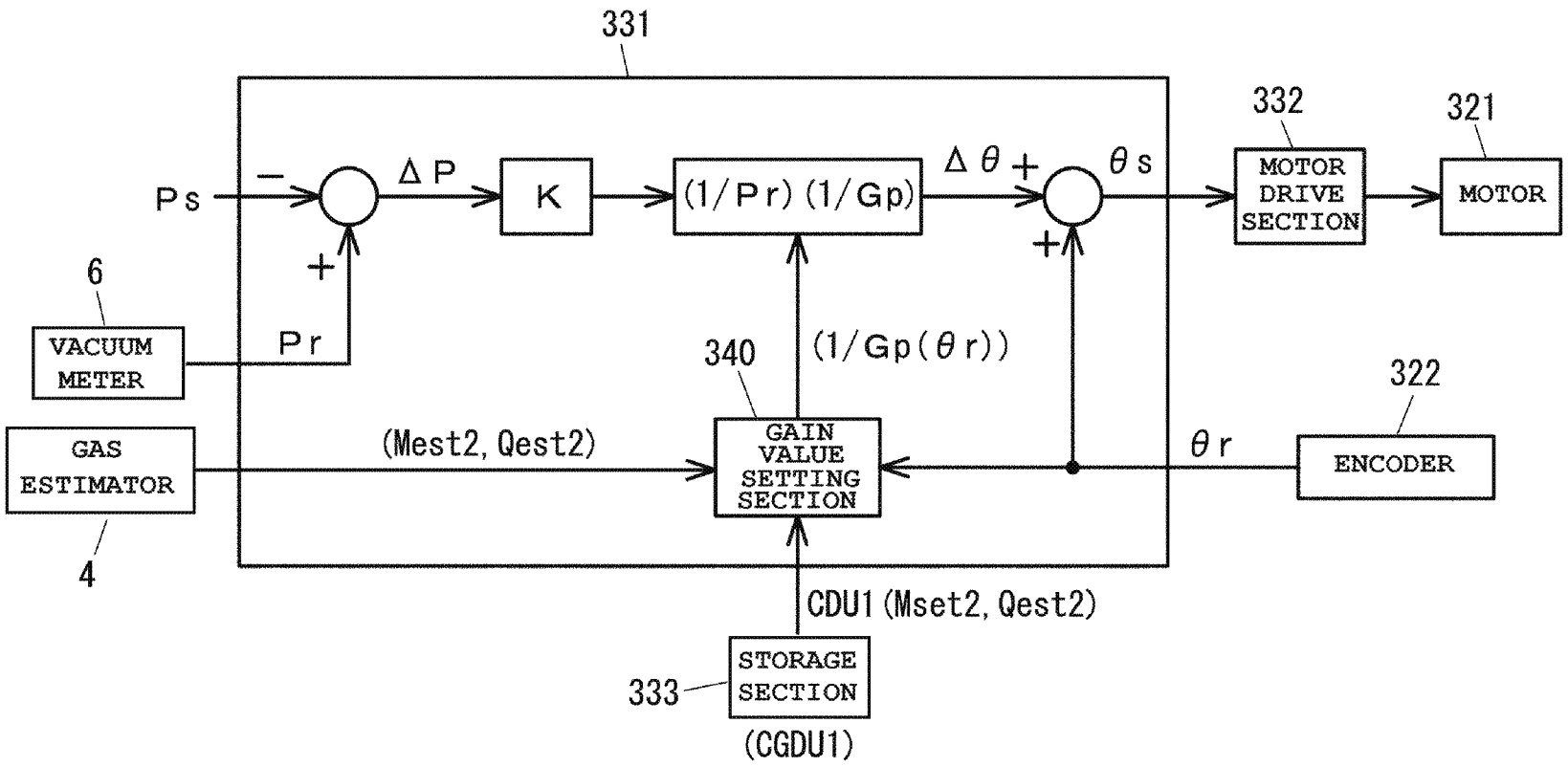
FIG. 6 is a block diagram for describing opening degree control (pressure control)

FIG. 6 is a block diagram for describing the opening degree control (the pressure control) of the control section 331 of the APC valve 3. The control section 331 calculates an opening degree operation amount Δθ for eliminating a pressure deviation ΔP (=Pr−Ps) as the deviation of the pressure measurement value Pr with respect to the target pressure value Ps, and outputs an opening degree instruction θs (=θr+Δθ). The opening degree operation amount Δθ is for generating a pressure change (−ΔP) for roughly eliminating the pressure deviation ΔP, and is represented as in Expression (1) below by means of the reciprocal sensitivity (1/Gp) based on the plant gain Gp. In Expression (1), K is a proportional gain with respect to the pressure deviation ΔP. (1/P)·(1/Gp) is gain correction introduced for cancelling the above-described influence of the plant gain.

$$\Delta\theta=(1/P)\cdot(1/Gp)\cdot K\cdot\Delta P \quad (1)$$

Although details will be described later, the storage section 333 stores a later-described initial data unit group GDU1 or a calibrated data unit group CGDU1. In an example illustrated in FIG. 6, the storage section 333 stores the calibrated data unit group CGDU1. The pressure control estimation value (Mest2, Qest2) is input from the gas estimator 4 to a gain value setting section 340, and the opening degree θr is input from the encoder 322 to the gain value setting section 340. The gain value setting section 340 selects, from the calibrated data unit group CGDU1, a data unit CDU1 corresponding to the pressure control estimation value (Mest2, Qest2), and outputs reciprocal sensitivity (1/Gp(θr)) at the opening degree θr. Using this reciprocal sensitivity (1/Gp(θr)), the gain correction (1/P)·(1/Gp) as represented by Expression (1) is performed.

In Expression (1), in the case of, e.g., Pr>Ps, ΔP>0 is satisfied, and therefore, the opening degree operation amount Δθ satisfies Δθ>0. That is, the opening degree θ is increased such that the pressure decreases. The opening degree θ measured by the encoder 322 is added to the calculated opening degree operation amount Δθ, and an addition result is, as the opening degree instruction θs (=θr+Δθ), output to the motor drive section 332.

Note that in the example illustrated in FIG. 6, the case of using the proportional gain has been described by way of example. However, the present invention is also applicable to an integral component, a derivative component, and other types of feedback control. Note that when K of FIG. 6 is the proportional gain+an integral gain (a so-called PI gain), Δθ represented by Expression (1) is directly used as the opening degree instruction θs (θs=Δθ), and addition of θr is not necessary.

(Plant Gain Gp and Effective Exhaust Velocity Se)

A relationship between a change Δθ in the opening degree θ and a change ΔP in the pressure is provided based on an exhaust expression shown in Expression (2). In Expression (2), V [$m^3$] is the volume of the vacuum chamber 5, and P [Pa] is the internal pressure of the vacuum chamber 5. Moreover, Se is an effective exhaust velocity determined from the exhaust velocity Sp of the turbo-molecular pump 2 and the conductance C of the APC valve 3, and is calculated by Expression (3).

$$Q=V\cdot(\Delta P/\Delta t)+P\cdot Se \quad (2)$$

$$(1/Se)=(1/Sp)+(1/C) \quad (3)$$

The exhaust velocity Sp of the turbo-molecular pump 2 depends on the gas type M and flow rate Q of gas to be exhausted, and the conductance C of the APC valve 3 changes according to the opening degree θ. Thus, the effective exhaust velocity Se depends on the gas type M, the flow rate Q, and the opening degree θ as in Se (M, Q, θ). Note that in the present specification, the type (name) of gas or the molecular weight of gas will be referred to as the "gas type," and is represented by a reference character M. That is, the gas type M indicates gas having the molecular weight M. Moreover, in the case of gas with a mixture of multiple gas types, such gas corresponds to the gas type M as gas having an average molecular weight M calculated from a flow rate mixing ratio.

At an equilibrium point of a vacuum system, Q=Constant and $\Delta P/\Delta t=0$ are satisfied. Thus, Expression (2) is $Q=P\cdot Se$. A relationship of increments $\Delta P$, $\Delta Se$ is $0=P\cdot\Delta Se+Se\cdot\Delta P$ from a difference between $Q=(P+\Delta P)\cdot(Se+\Delta Se)$ and $Q=P\cdot Se$. Because of $\Delta Se=(\Delta Se/\Delta\theta)\cdot\Delta\theta$, Expression (4) is obtained from both expressions. When Expression (4) is further transformed, Expression (5) below is obtained. As described above, the plant gain Gp is represented by the effective exhaust velocity Se of the vacuum pumping device 1.

$$\Delta\theta=-\{(1/P)\cdot Se/(\Delta Se/\Delta\theta)\}\cdot\Delta P \quad (4)$$

$$Gp=-(\Delta P/\Delta\theta)/P=(\Delta Se/\Delta\theta)/Se \quad (5)$$

(Characteristics of Effective Exhaust Velocity Se)

Figure 7:
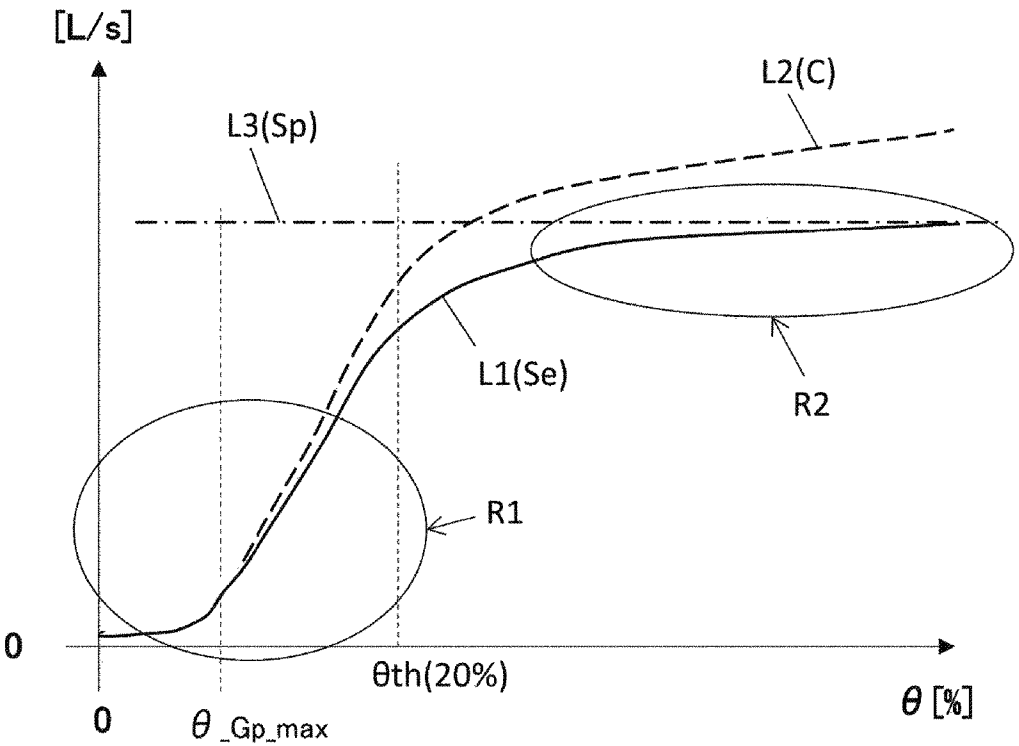
FIG. 7 is a graph of opening degree dependency of an effective exhaust velocity.

FIG. 7 is a graph of opening degree dependency of the effective exhaust velocity Se. In FIG. 7, the vertical axis represents the exhaust velocity or the conductance [L/s], and the horizontal axis represents the opening degree θ (%). A line L1 indicates the effective exhaust velocity Se, a line L2 indicates the conductance C of the APC valve 3, and a line L3 indicates the exhaust velocity Sp of the turbo-molecular pump 2. The exhaust velocity Sp of the turbo-molecular pump 2 is a constant value regardless of the opening degree θ.

Generally, in a range R1 with a small opening degree θ, the second term including the conductance C is dominant on the right side of Expression (3), and the line L1 of the effective exhaust velocity Se approaches the line L2 of the conductance C of the APC valve 3. Conversely, in a range R2 with a great opening degree θ, the first term including the exhaust velocity Sp is dominant on the right side of Expression (3), and the line L1 of the effective exhaust velocity Se approaches the line L3 of the exhaust velocity Sp of the turbo-molecular pump 2. FIG. 7 shows a case where a boundary θth between the range where the conductance C is dominant and the range where the exhaust velocity Sp of the turbo-molecular pump 2 is dominant is 20%. At an opening degree θ of lower than 20%, the conductance C of the APC valve 3 is dominant. At an opening degree θ of equal to or higher than 20%, the exhaust velocity Sp of the turbo-molecular pump 2 is dominant. The opening degree θ_Gp_max with the maximum plant gain Gp as described above is included in the opening degree range where the conductance C is dominant.

The exhaust velocity Sp of the turbo-molecular pump 2 varies according to the gas type of gas to be exhausted. Thus, in the range where the exhaust velocity Sp is dominant, the line L1 of the effective exhaust velocity Se is shifted up and down according to the gas type. A typical turbo-molecular pump is designed such that the exhaust velocity is the maximum for a gas type having the substantially same level of molecular weight as that of $N_2$ gas, and the exhaust velocity decreases even when the molecular weight is greater or smaller than that of the $N_2$ gas.

Figure 8:
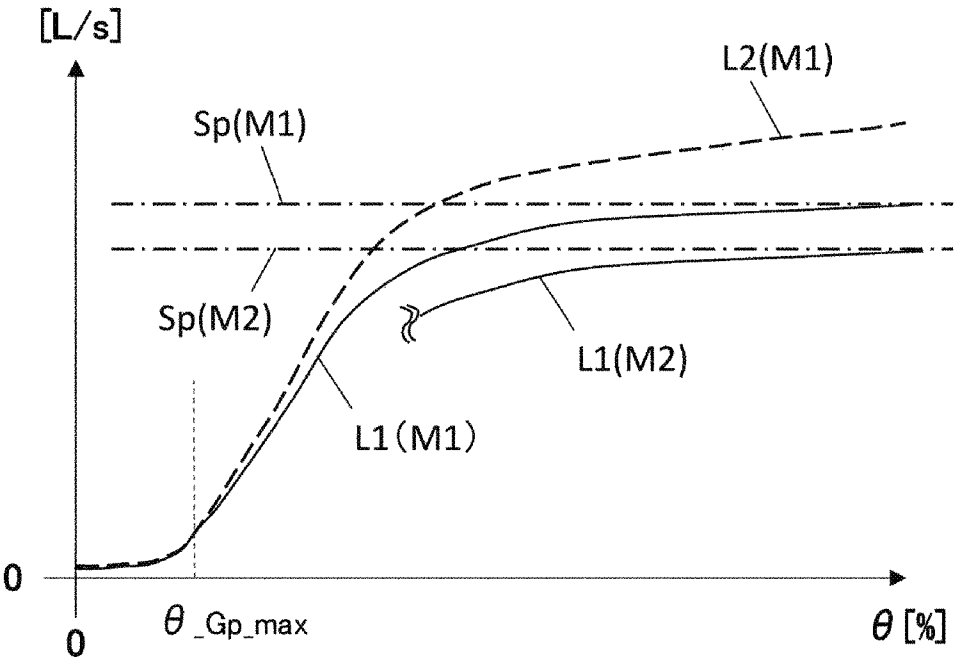
FIG. 8 is a graph of gas type dependency of the effective exhaust velocity in a range with a great opening degree.

FIG. 8 is a graph for describing gas type dependency of the effective exhaust velocity Se in the range with the great opening degree. A line Sp(M1) indicates the exhaust velocity Sp of the turbo-molecular pump 2 in the case of a gas type M1, and a line Sp(M2) indicates the exhaust velocity Sp of the turbo-molecular pump 2 in the case of a gas type M2 different from M1. In a case where the gas type M1 is the $N_2$ gas with the maximum exhaust velocity, the exhaust velocity Sp(M2) of the gas type M2 different from the $N_2$ gas falls below the exhaust velocity Sp(M1) regardless of the gas type. Thus, in the opening degree range where the exhaust velocity Sp is dominant, the line L1(M2) indicating the effective exhaust velocity Se of the gas type M2 is shifted downward with respect to the line L1(M1) indicating the effective exhaust velocity Se of the gas type M1.

(Characteristics of Plant Gain Gp)

The plant gain Gp shown in FIG. 4 is represented using the effective exhaust velocity Se of the vacuum pumping device 1 as shown in Expression (5). In the range with the small opening degree θ, the conductance C of the APC valve 3 is dominant, and a greater molecular weight results in a smaller conductance C at the same opening degree. Thus, tendency shows that a gas type with a greater molecular weight results in a greater plant gain Gp. Conversely, in the range with the great opening degree θ, the exhaust velocity Sp of the turbo-molecular pump 2 is dominant. Thus, tendency shows that regardless of the magnitude of the molecular weight, a gas type with a smaller exhaust velocity Sp results in a greater plant gain Gp.

Figure 9A:
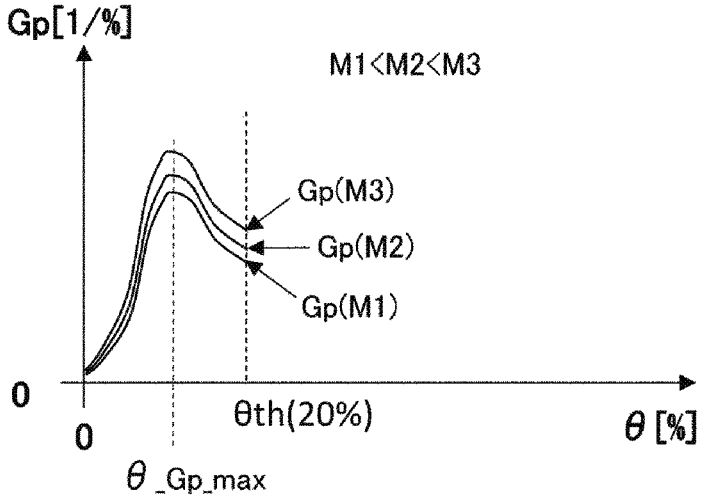
FIGS. 9A and 9B are graphs of one example of gas type dependency of the plant gain Gp.
Figure 9B:
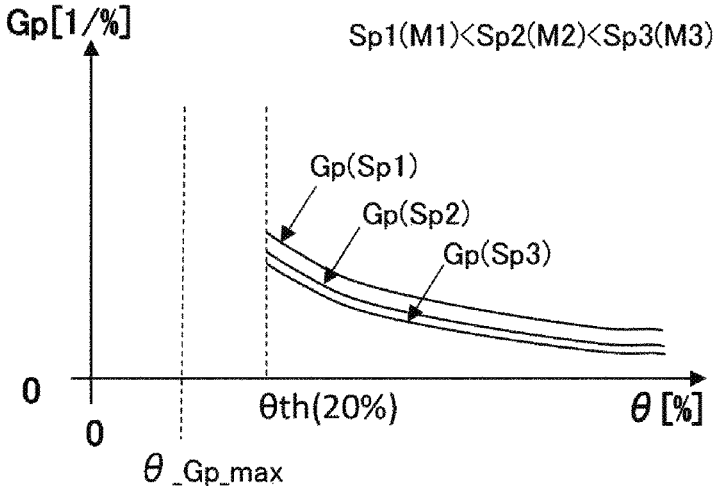

FIGS. 9A and 9B show one example of gas type dependency of the plant gain Gp described above. In the case of FIGS. 9A and 9B, the effective exhaust velocity Se is, as in the case of FIG. 7, described assuming that the conductance C of the APC valve 3 is dominant at θ<θth and the exhaust velocity Sp of the turbo-molecular pump 2 is dominant at θ≥θth.

FIG. 9A shows characteristics of the plant gain Gp at θ<θth, and a gas type with a greater molecular weight results in a greater plant gain Gp. The molecular weights M1, M2, M3 are in a magnitude relationship as in M1<M2<M3, and a magnitude relationship among the plant gains Gp(M1), Gp(M2), Gp(M3) of the gas types with the molecular weights M1, M2, M3 is Gp(M1)<Gp(M2)<Gp(M3).

FIG. 9B shows characteristics of the plant gain Gp at θ≥θth, and tendency shows that a gas type with a smaller exhaust velocity Sp results in a greater plant gain Gp. A magnitude relationship among the exhaust velocities Sp1(M1), Sp2(M2), Sp3(M3) of the gas types with the molecular weights M1, M2, M3 is assumed as Sp1(M1)<Sp2(M2)<Sp3(M3). In this case, a magnitude relationship among the plant gains Gp(Sp1), Gp(Sp2), Gp(Sp3) of the gas types with the exhaust velocities Sp1(M1), Sp2(M2), Sp3(M3) is Gp(Sp1)>Gp(Sp2)>Gp(Sp3).

Typically, in the case of using the APC valve 3 in a vacuum processing device such as an etching device, initial calibration processing is normally performed after the vacuum pumping device 1 (the turbo-molecular pump 2+the APC valve 3) has been attached to the vacuum chamber 5 of the vacuum processing device. Generally, gain correction (see FIG. 6) in the control section 331 as described above is performed on the premise of representative gas conditions or average gas conditions of process conditions to be applied. For example, in many cases, the average molecular weight of a gas mixture is obtained, and a relatively-easily handleable gas type having a molecular weight corresponding to the average molecular weight is used as a substitution for gas to be used in this case.

However, a difference in the magnitude of the plant gain Gp is caused according to the gas type as described above. For this reason, even when the plant gain Gp is calibrated only for the representative gas type in the above-described initial calibration processing to set the reciprocal sensitivity (1/Gp), the pressure control might not be able to be properly performed in actual control for different gas types.

For example, in a case where the actual plant gain Gp upon the pressure control is higher with respect to the reciprocal sensitivity (1/Gp) after calibration, a closed loop gain of a feedback control system is relatively high, leading to a vibrational response. Conversely, in a case where the actual plant gain Gp upon the pressure control is lower with respect to the reciprocal sensitivity (1/Gp) after calibration, the closed loop gain of the feedback control system is relatively low, leading to an over-damped response.

In the typical APC valve, the gas type upon the pressure control cannot be estimated. For this reason, even if the data unit on various gas types is stored as the reciprocal sensitivity (1/Gp) data, it cannot be determined which gas type of the data unit needs to be applied upon the pressure control. Thus, the above-described problems upon the pressure control are caused.

For these reasons, in the present embodiment, the gas type and the flow rate are estimated in the control section 41 of the gas estimator 4, and the control section 331 of the valve controller 33 performs the pressure control based on the estimated gas type and flow rate.

Figure 10:
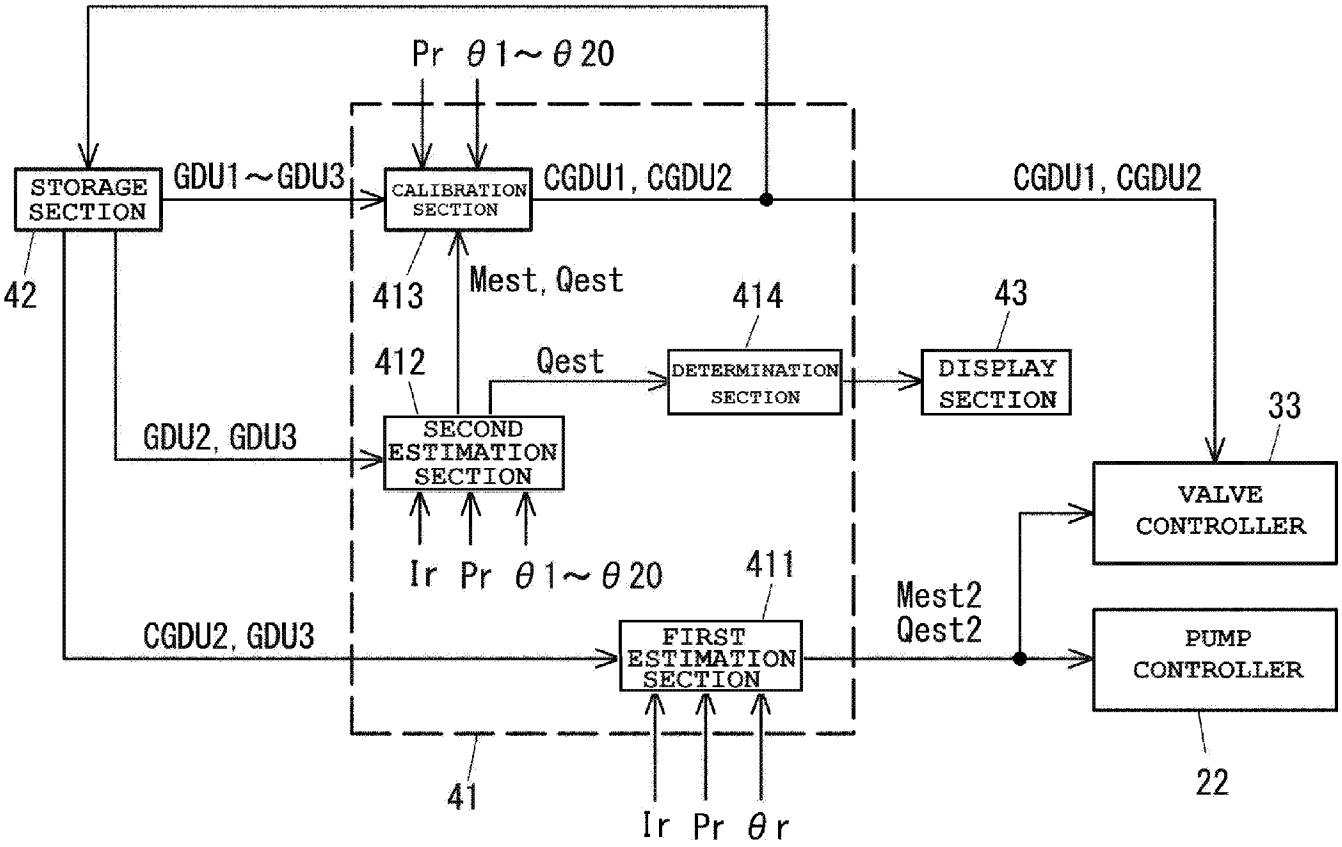
FIG. 10 is a functional block diagram regarding a control section of a gas estimator.

FIG. 10 is a functional block diagram of the control section 41. The control section 41 has a first estimation section 411, a second estimation section 412, a calibration section 413, and a determination section 414.

In the storage section 42 of the gas estimator 4, the initial data unit group GDU1, an initial data unit group GDU2, and an initial data unit group GDU3 are stored. The initial data unit group GDU1 is data regarding the reciprocal sensitivity (1/Gp). The initial data unit group GDU2 is data regarding the effective exhaust velocity Se of the vacuum pumping device 1. The reciprocal sensitivity (1/Gp) pf GDU1 and the effective exhaust velocity Se of GDU2 are first correlation data indicating a correlation among the gas type M and flow rate Q of gas to be vacuum-pumped and the opening degree θ of the APC valve 3. The initial data unit group GDU3 is second correlation data indicating a correlation among the flow rate Q, the gas type M, and a motor current value I in the turbo-molecular pump 2.

Upon the calibration processing, each pressure measurement value Pr when the opening degree θ is sequentially changed to multiple opening degrees θ1 to θ20 upon gas discharging with a predetermined flow rate Q0 is input to the second estimation section 412. The second estimation section 412 is configured to estimate the flow rate Qest and gas type Mest of gas to be vacuum-pumped by the vacuum pumping device 1 based on the opening degrees θ1 to θ20, the acquired multiple pressure measurement values Pr, the motor current value Ir of the turbo-molecular pump 2, the initial data unit group GDU2, and the initial data unit group GDU3.

The calibration section 413 is configured to calibrate the initial data unit groups GDU1, GDU2 based on the gas type Mest estimated by the second estimation section 412 upon the calibration processing, the predetermined flow rate Q0, the acquired multiple pressure measurement values Pr, the opening degrees θ1 to θ20, and the initial data unit group GDU2. The calibrated data unit groups CGDU1, CGDU2 are stored in the storage section 42, and are output to the valve controller 33 of the APC valve 3.

The determination section 414 is configured to determine whether or not the flow rate Qest estimated by the second estimation section 412 upon the calibration processing is a proper flow rate. Although details of determination processing will be described later, it is determined as not proper in a case where the flow rate Qest for the predetermined flow rate Q0 introduced upon calibration with respect to a threshold ΔQth satisfies |Q0−Qest1|≥ΔQth. A determination result is displayed on the display section 43.

The first estimation section 411 is configured to estimate the flow rate Qest2 and gas type Mest2 of gas to be vacuum-pumped upon pressure control based on the motor current value Ir of the turbo-molecular pump 2, the opening degree θr of the APC valve 3, the pressure measurement value Pr of the vacuum chamber 5, the calibrated data unit group CGDU2, and the initial data unit group GDU3. An estimation result is input to the valve controller 33, and is utilized for the later-described pressure control.

(Description of Initial Data Unit Groups)

As described above, the initial data unit group GDU1 regarding the reciprocal sensitivity (1/Gp), the initial data unit group GDU2 regarding the effective exhaust velocity Se, and the initial data unit group GDU3 regarding the correlation among the molecular weight M and flow rate Q of gas in the case of constantly maintaining the motor current value I of the turbo-molecular pump 2 are stored in the storage section 42 of the gas estimator 4. These initial data unit groups GDU1 to GDU3 are acquired with a preset chamber being attached to the vacuum pumping device 1 in a manufacturer, and do not necessarily correspond to the vacuum chamber 5 of the vacuum processing device illustrated in FIG. 1.

Note that the initial data unit group GDU3 is stored in the storage section 223 of the pump controller 22, and the gas estimator 4 reads the initial data unit group GDU3 from the storage section 223 of the pump controller 22 to store the initial data unit group GDU3 in the storage section 42. Needless to say, the initial data unit group GDU3 may be stored in the storage section 42 of the gas estimator 4 in advance instead of reading the initial data unit group GDU3 from the pump controller 22 to the gas estimator 4.

The same applies to the initial data unit group GDU1 regarding the reciprocal sensitivity (1/Gp) and the initial data unit group GDU2 regarding the effective exhaust velocity Se. That is, a configuration may be employed, in which the initial data unit groups GDU1, GDU2 are stored in the storage section 333 of the valve controller 33 and the gas estimator 4 reads these initial data unit groups GDU1, GDU2 from the storage section 333 to store the initial data unit groups GDU1, GDU2 in the storage section 42. Alternatively, a configuration may be employed, in which the initial data unit groups GDU1, GDU2 are stored in the storage section 42 in advance.

Figure 11:
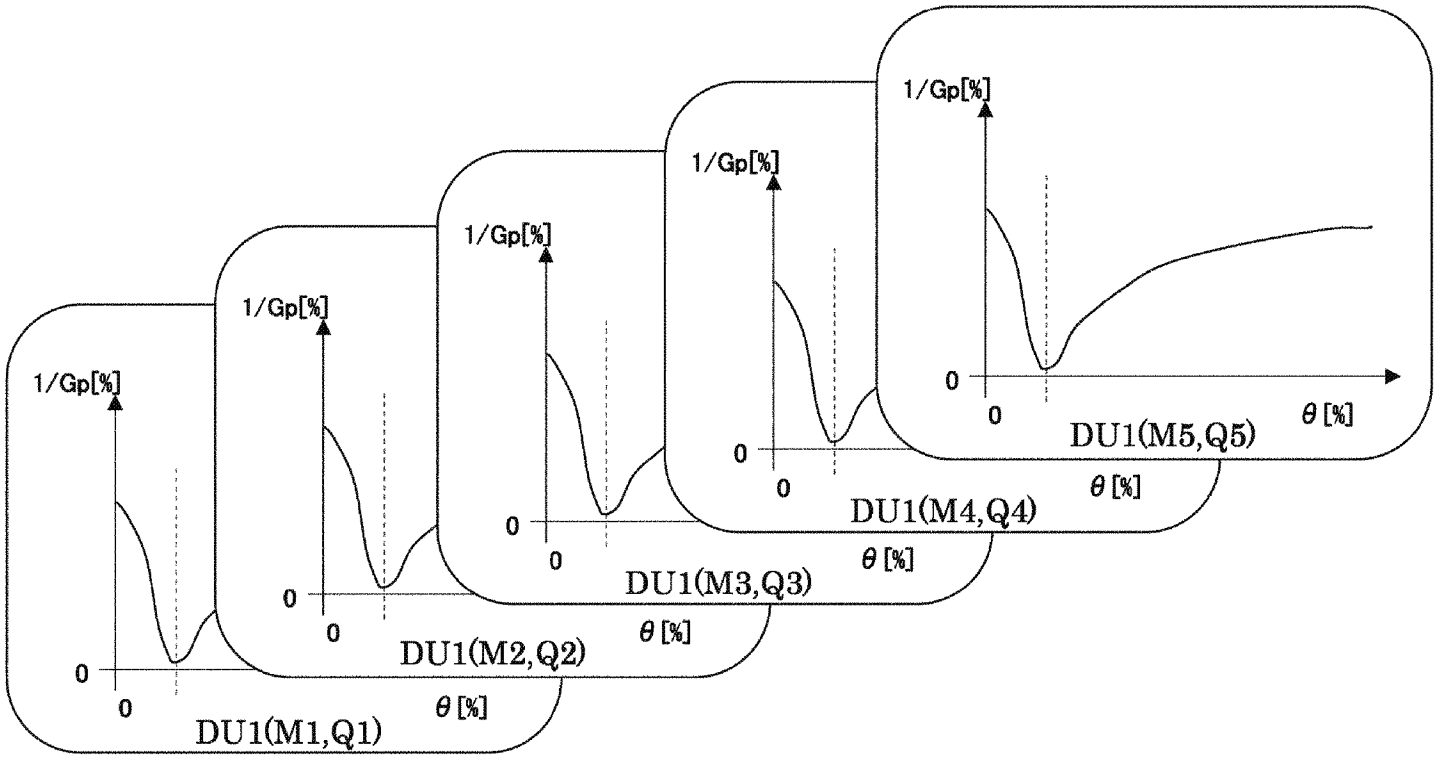
FIG. 11 is a schematic view of an initial data unit group GDU1.

FIG. 11 is a schematic view of an image of the initial data unit group GDU1 regarding the reciprocal sensitivity (1/Gp). The initial data unit group GDU1 is a group of initial data units DU1(M, Q) indicating a correlation between the opening degree θ and the reciprocal sensitivity (1/Gp). The initial data unit DU1(M, Q) is a data unit indicating the correlation between the opening degree θ and the reciprocal sensitivity (1/Gp) at a certain gas type (molecular weight) M and a certain flow rate Q.

FIG. 11 shows five initial data units DU1(M1, Q1), DU1(M2, Q2), DU1(M3, Q3), DU1(M4, Q4), DU1(M5, Q5) corresponding to five types of combinations (M1, Q1), (M2, Q2), (M3, Q3), (M4, Q4), (M5, Q5) regarding the gas type (molecular weight) M and the flow rate Q among the multiple initial data units DU1(M, Q) included in the initial data unit group GDU1. For example, the initial data unit DU1 (M1, Q1) shows the correlation between the opening degree θ and the reciprocal sensitivity (1/Gp) in the case of inflow of the flow rate Q1 of gas with the gas type M1.

For example, 20 points are set for the opening degree θ between 0% and 100%, six gas types of $H_2$, He, $N_2$, Ar, Kr, and Xe are selected as representative gas types, six points are set for the flow rate Q between 10 sccm and 2000 sccm, and the (1/Gp) values for the total of 720 points (=20×6×6) are input. In this case, the (1/Gp) values for 20 points are input to the initial data unit DU1(M1, Q1) of FIG. 11, and the initial data unit group GDU1 includes 36 units of the initial data units DU1(M, Q).

Figure 12:
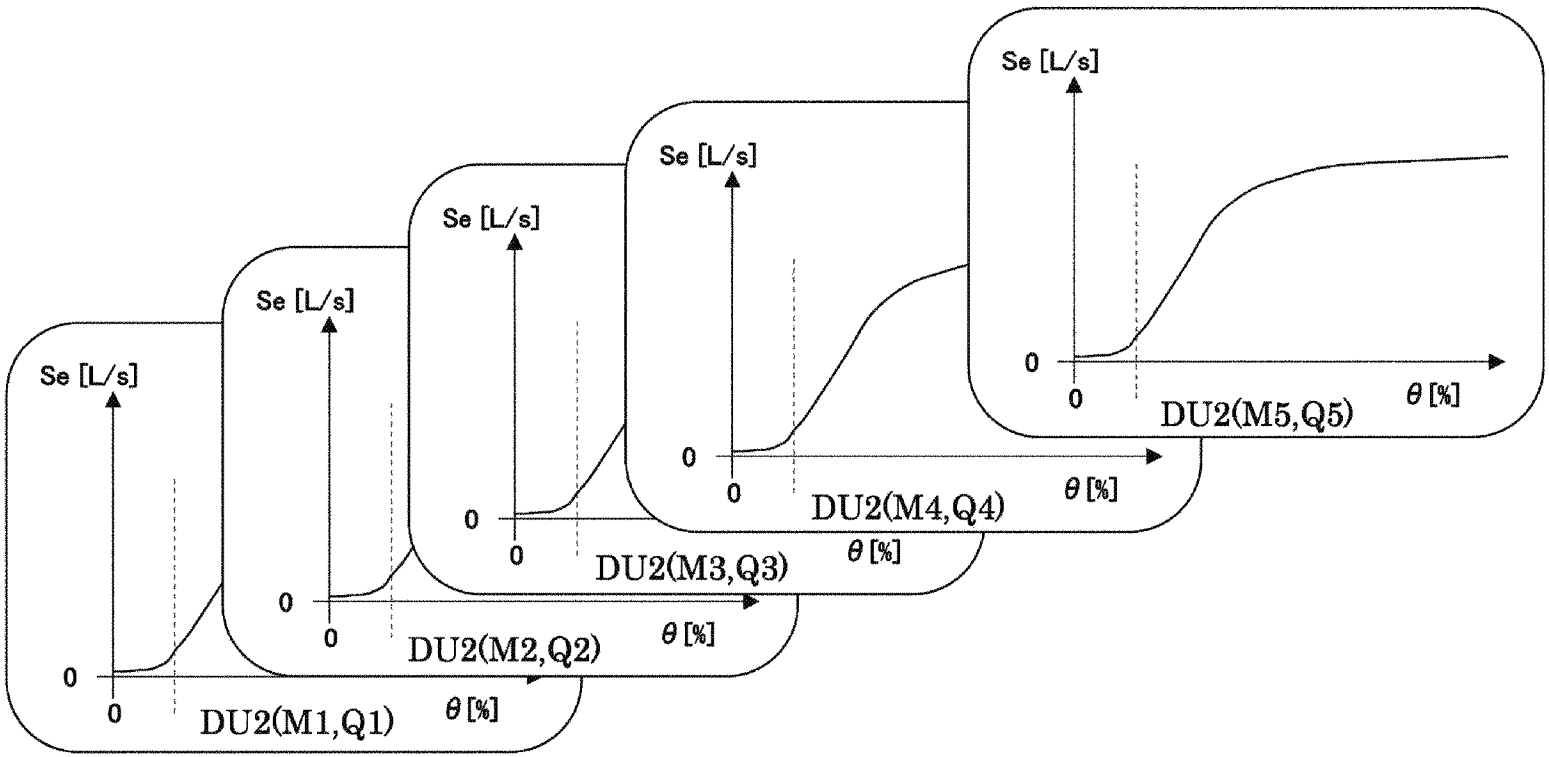
FIG. 12 is a schematic view of an initial data unit group GDU2.

FIG. 12 is a schematic view of an image of the initial data unit group GDU2 regarding the effective exhaust velocity Se. The initial data unit group GDU2 is a group of initial data units DU2(M, Q) indicating a correlation between the opening degree θ and the effective exhaust velocity Se. The initial data unit DU2 (M, Q) is a data unit indicating the correlation between the opening degree θ and the effective exhaust velocity Se at a certain gas type (molecular weight) M and a certain flow rate Q.

FIG. 12 shows five initial data units DU2(M1, Q1), DU21(M2, Q2), DU2(M3, Q3), DU2(M4, Q4), DU2(M5, Q5) corresponding to five types of combinations (M1, Q1), (M2, Q2), (M3, Q3), (M4, Q4), (M5, Q5) regarding the molecular weight M and the flow rate Q among the multiple initial data units DU2(M, Q) included in the initial data unit group GDU2. For example, the initial data unit DU2(M1, Q1) shows the correlation between the opening degree θ and the effective exhaust velocity Se in the case of inflow of the flow rate Q1 of gas with the gas type M1.

Figure 13:
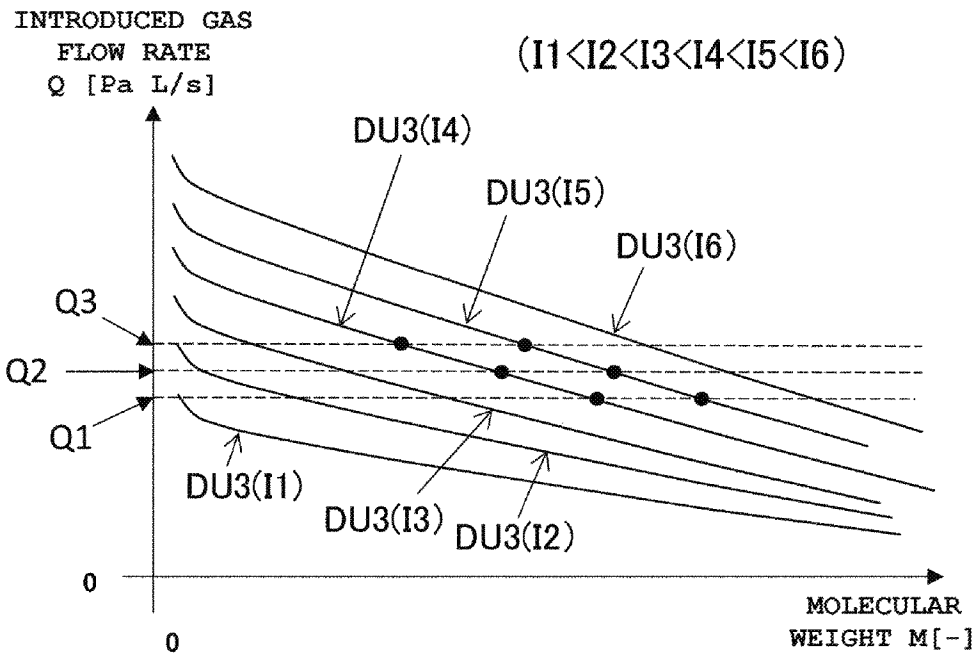
FIG. 13 is a schematic view of an initial data unit group GDU3.

FIG. 13 is a schematic view of an image of the initial data unit group GDU3. The initial data unit group GDU3 includes multiple initial data units DU3(I), and FIG. 13 shows six initial data units DU3(I1), DU3(I2), DU3(I3), DU3(I4), DU3(I5), DU3(I6) among the multiple data units. A magnitude relationship among the motor current values I1 to I6 is I1<I2<I3<I4<I5<I6.

The turbo-molecular pump 2 provides gas molecules with a momentum component in an exhaust side direction, and in this manner, the inflow gas molecules through the suction port are transferred to an exhaust port side. Thus, in the turbo-molecular pump 2, when the gas flow rate Q is constant, if the gas type (molecular weight) M to be exhausted varies, the motor current value I for rotatably driving a pump rotor at a rated rotation speed varies.

Figure 14:
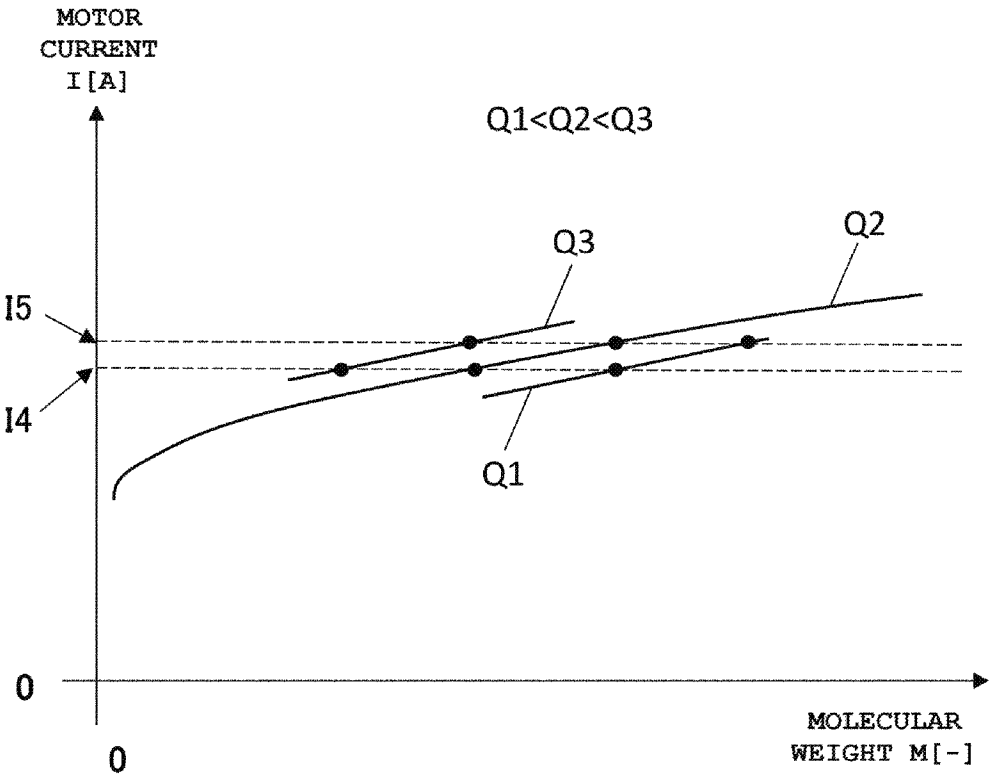
FIG. 14 is a graph for describing a relationship between a motor current value I and a molecular weight M in the case of a constant flow rate Q.

FIG. 14 is a graph for describing a relationship between the motor current value I and the molecular weight M in the case of the constant flow rate Q. FIG. 14 shows I-M curves regarding three types of flow rates Q1, Q2, Q3. Note that I-M curves in a case where the motor current value I is around I4 to I5 are shown as the I-M curves regarding the flow rates Q1, Q3. A magnitude relationship among the flow rates Q1, Q2, Q3 is Q1<Q2<Q3.

The initial data unit DU3(I4) of FIG. 13 is obtained in such a manner that data groups (M, Q) in the case of the motor current value I4 (a constant value) in FIG. 14 are plotted on M-Q coordinates of FIG. 13. Similarly, the initial data unit DU3(I5) of FIG. 13 is obtained in such a manner that data groups (M, Q) in the case of the motor current value I5 (a constant value) in FIG. 14 are plotted on the M-Q coordinates of FIG. 13.

In a case where the number of data points of the gas type (molecular weight) M is six and the number of data points of the motor current value I is 20, the initial data unit group GDU3 in FIG. 13 includes 20 lines indicating the initial data units DU3(I1) to DU3(I20). Each line indicating the initial data units DU3(I1) to DU3(I20) includes six data points.

(1: Calibration of Initial Data Unit Groups in Gas Estimator 4)

As described above, the initial data unit groups GDU1 to GDU3 stored in the storage section 42 in advance are acquired based on a certain chamber. Thus, for performing pressure control by the APC valve 3 with high accuracy, the initial data unit groups GDU1 to GDU3 need to be calibrated into data unit groups according to the vacuum system (the vacuum chamber) to be actually attached to the vacuum pumping device 1. Note that the calibration processing is, for example, performed according to an operator's instruction when an exhaust system is attached to the vacuum processing device, and thereafter, is performed according to the operator's instruction upon periodic maintenance or in a case where the process conditions greatly vary.

Figure 15:
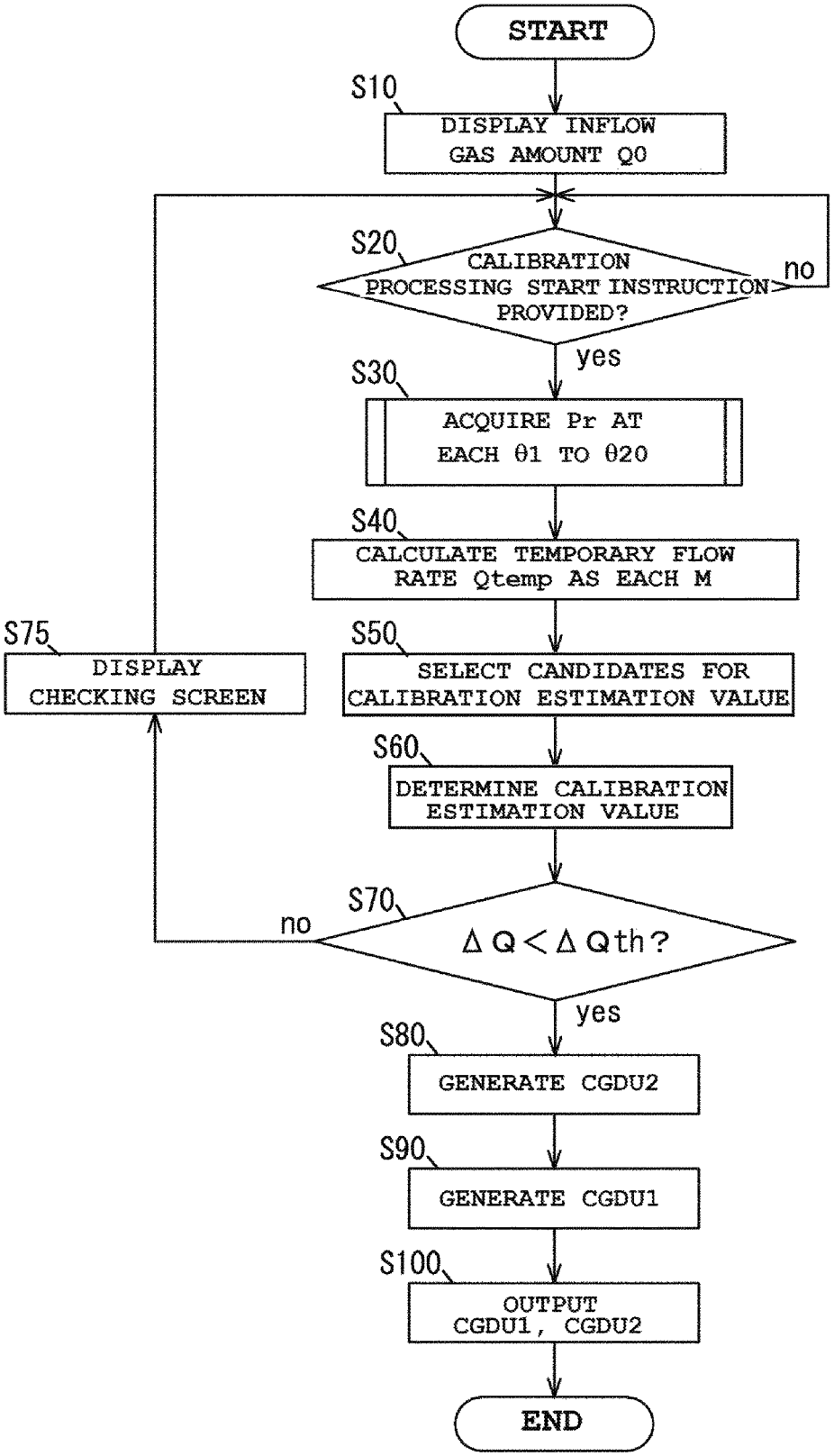
FIG. 15 is a flowchart of one example of the procedure of calibration processing.

FIG. 15 is a flowchart of one example of the procedure of the calibration processing executed by the calibration section 413 of the gas estimator 4. In the vacuum pumping device 1 of the present embodiment, an operator operates the input operation section 44 of the gas estimator 4 so that a calibration processing instruction can be input. The control section 41 of the gas estimator 4 starts the calibration processing shown in FIG. 15 when the calibration processing instruction is input.

At a step S10, the control section 41 causes the display section 43 to display a display screen for the calibration processing. On such a display screen, an instruction screen for causing the flow rate Q0 of gas to flow into the vacuum chamber 5 is displayed. The operator causes the flow rate Q0 of gas with a gas type M0 available in the field to flow into the vacuum chamber 5, and inputs a calibration processing start instruction via the input operation section 44.

At a step S20, it is determined whether or not the operator has input the calibration processing start instruction, and the processing proceeds to a step S30 in a case where the input is made.

At the step S30, an instruction for sequentially and intermittently changing the opening degree θ from θ1 to θ20 is transmitted to the APC valve 3, and the processing of acquiring, from the vacuum meter 6, the pressure measurement values Pr(Q0, θ1) to Pr(Q0, θ20) for the opening degrees θ1 to θ20 is executed. Measurement of the pressure measurement value Pr is performed after waiting until a pressure change ΔP after a change in the opening degree reaches equal to or less than a preset threshold, for example.

At a step S40, temporary flow rates Qtemp(M1, θ1) to Qtemp(M1, θ20), Qtemp(M2, θ1) to Qtemp(M2, θ20), Qtemp(M3, θ1) to Qtemp(M3, θ20), Qtemp(M4, θ1) to Qtemp(M4, θ20), Qtemp(M5, θ1) to Qtemp(M5, θ20), Qtemp(M6, θ1) to Qtemp(M6, θ20) are, for each of the gas types M1 to M6, calculated based on the pressure measurement values Pr(Q0, θ1) to Pr(Q0, θ20) acquired at the step S30. As shown in Expression (6) below, each temporary flow rate Qtemp(Mi, θj) is calculated based on the pressure measurement value Pr(Q0, θj) and Se(Q0, Mi, θj) at the flow rate Q0 in the initial data unit group GDU2 (see FIG. 12) regarding the effective exhaust velocity Se. Note that i is an integer of 1≤i≤6, and j is an integer of 1≤j≤20.

$$\mathrm{Qtemp}(Mi,\theta j)=Se(Q0,Mi,\theta j)\times Pr(Q0,\theta j) \tag{6}$$

The temporary flow rate Qtemp(Mi, θj) calculated according to Expression (6) is Qtemp(Mi, θj)=Q0 when a gas type Mi is the same gas type as that of actually-introduced gas, and is Qtemp(Mi, θj)≠Q0 when the gas type Mi is a different gas type. Note that the vacuum chamber from which the initial data unit group GDU2 is acquired and the vacuum chamber 5 of the user are different from each other in a configuration (e.g., a shape or an internal structure), and a conductance on an upstream side of the APC valve 3 varies. Thus, a deviation between an actual effective exhaust velocity and Se(Q0, Mi, θj) is caused. For this reason, even if the gas type Mi is coincident with the introduced gas, the calculated temporary flow rate Qtemp (Mi, θj) is slightly shifted from the actual flow rate Q0.

At a step S50, the temporary flow rates Qtemp of which errors from the flow rate Q0 are smaller than a threshold (an allowable error) are selected as candidates for a gas type flow rate estimation value (Mest, Qest) (herein referred to as a "calibration estimation value") of gas introduced upon calibration. For example, a root mean square (RMS) for a difference from the flow rate Q0 is calculated for 20 temporary flow rates Qtemp(Mi, θj) regarding the same gas type Mi, and multiple values of which RMSs are smaller than a predetermined threshold or multiple values taken in ascending order according to the RMS are taken as the candidates for the calibration estimation value (Mest, Qest).

Specifically, for each of six gas types Mi, the difference ΔQj=Qtemp(Mi, θj)−Q0 is obtained for each of the opening degrees θj of θ1 to θ20, and the root mean square RMS(Mi) is calculated as in Expression (7). Then, multiple values (e.g., three values) taken in ascending order among six values of RMS(Mi) are taken as the candidates for the calibration estimation value (Mest, Qest).

$$RMS(Mi)=\sqrt{\{(\Delta Q1^2+\Delta Q2^2+\Delta Q3^2+\ldots+\Delta Q19^2+\Delta Q20^2)/20\}} \quad (7)$$

At a step S60, the final calibration estimation value (Mest, Qest) is determined from the candidates for the calibration estimation value (Mest, Qest) as selected at the step S50 based on the motor current value I of the turbo-molecular pump 2.

As described above, the typical turbo-molecular pump is designed such that the exhaust velocity Sp is the maximum for the gas type having the substantially same level of molecular weight as that of the $N_2$ gas, and the exhaust velocity decreases even when the molecular weight is greater or smaller than that of the $N_2$ gas. Thus, there is a case where the exhaust velocity Sp for the gas type having a greater molecular weight than that of the $N_2$ gas and the exhaust velocity Sp for the gas type having a smaller molecular weight than that of the $N_2$ gas are substantially the same as each other. In a case where the above-described six gas types include these gas types, even when the gas type varies, the substantially same effective exhaust velocity Se is provided, and there is a probability that the same RMS is provided. For this reason, the final calibration estimation value (Mest, Qest) cannot be accurately determined.

As shown in the initial data unit group GDU3 shown in FIG. 13, M-Q curves, i.e., the initial data units DU3, indicating the correlation between the molecular weight (the gas type) M and the flow rate Q vary according to the magnitude of the motor current value I. For example, when the motor current value is I4, the data (M, Q) is on the curve indicating the initial data unit DU3(I4). Thus, in a case where gas type candidates are Ma, Mb, and Mc as shown in FIG. 16, one with the smallest difference between Q(Ma), Q(Mb), Q(Mc) obtained by application of these gas types to the initial data units DU3(I) and the temporary flow rate Qtemp (Ma, θj), Qtemp (Mb, θj), Qtemp (Mc, θj) corresponding to Q(Ma), Q(Mb), Q(Mc) is taken as the final calibration estimation value (Mest, Qest).

Figure 16:
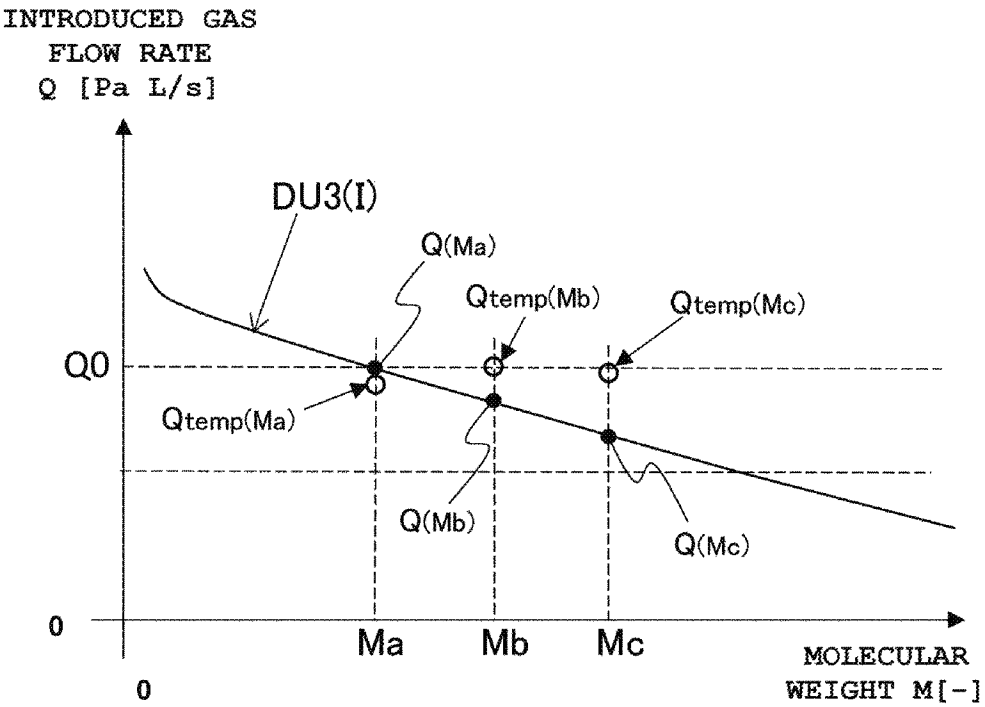
FIG. 16 is a graph of an initial data unit DU3(I) and a temporary flow rate Qtemp.

FIG. 16 is a graph of a line indicating the initial data unit DU3(I) and the temporary flow rates Qtemp(Ma, θj), Qtemp (Mb, θj), Qtemp(Mc, θj) on the MQ coordinates. Note that in FIG. 16, the temporary flow rates Qtemp(Ma, θj), Qtemp (Mb, θj), Qtemp(Mc, θj) are shown as Qtemp(Ma), Qtemp (Mb), Qtemp(Mc). Moreover, the line of the initial data unit DU3(I) shows, as Q0, the flow rate at the molecular weight (the gas type) Ma. In the case of an example shown in FIG. 16, the temporary flow rate Qtemp(Ma, θj) is closest to the line indicating the initial data unit DU3(I), and (Ma, Q0) is determined as the calibration estimation value (Mest, Qest).

At the step S60, the motor current value Ir is acquired from the pump controller 22 of the turbo-molecular pump 2, and Q(Ma), Q(Mb), Q(Mc) as described above are obtained from the initial data unit DU3(Ir) corresponding to the motor current value Ir. In this case, Ma, Mb, and Mc are any of M1 to M6. Then, by comparison of the magnitudes of the differences |Q(Ma)−Qtemp(Ma, θj)|, |Q(Mb)−Qtemp(Mb, θj)|, |Q(Mc)−Qtemp(Mc, θj)|, the gas type with the smallest magnitude of the difference is taken as the Mest of the final calibration estimation value (Mest, Qest). The flow rate Q0 of the actual inflow is taken as Qest.

Note that the opening degree θj for the temporary flow rate Qtemp(Mi, θj) upon comparison of the magnitude of the difference may be any of θ1 to θ20, but an opening degree (e.g., θ20) in the range where the exhaust velocity Sp of the turbo-molecular pump in the effective exhaust velocity Se is preferably selected.

At a step S70, it is determined whether or not the estimated flow rate Qest greatly deviates from the introduced flow rate Q0. At this step, the operator determines whether or not the flow rate Q0 as displayed on the display section 43 at the step S10 flows into the vacuum chamber 5. In a case where the inflow is different from the flow rate Q0, the flow rate Qest calculated based on the flow rate Q0 greatly deviates from the flow rate Q0. For this reason, in the processing of the step S70, the operator determines whether or not the flow rate Q0 of gas has flowed in as instructed.

At the step S70, deviation is determined based on whether or not the difference magnitude ΔQ=|Q0−Qest| with respect to the threshold ΔQth satisfies ΔQ<ΔQth. In this case, in the case of ΔQ<ΔQth, deviation is small, and it is determined that the flow rate Q0 as instructed has flowed in. Then, the processing proceeds to a step S80. On the other hand, in the case of ΔQ≥ΔQth, deviation is great, and it is determined that the flow rate Q0 as instructed does not flow in. Then, the processing proceeds to a step S75.

In a case where the processing proceeds from the step S70 to the step S75 after determination as ΔQ≥ΔQth, a checking screen for prompting checking of the flow rate is displayed on the display section 43 at the step S75. Thereafter, the processing proceeds to the step S20, and waits for the calibration processing instruction from the operator.

On the other hand, in a case where the processing proceeds to the step S80 after determination as ΔQ<ΔQth, the calibrated data unit group CGDU2 obtained by the calibration processing for the initial data unit group GDU2 is generated based on the gas type estimation value Mest determined at the step S60, the flow rate Q0 upon calibration, and the pressure measurement values Pr(Q0, θ1) to Pr(Q0, θ20) measured upon calibration.

Using the flow rate Q0 upon calibration and the pressure measurement values Pr(Q0, θ1) to Pr(Q0, θ20) measured upon calibration, an effective exhaust velocity (hereinafter referred to as an "acquired calibration exhaust velocity") Scal(Mest, Q0, θj) based on the measurement values is first calculated by Expression (8) below. The generated calibrated data unit group CGDU2 is stored in the storage section 42.

$$\mathrm{Scal}(\mathrm{Mest},Q0,\theta j)=Q0/Pr(Q0,\theta j) \quad (8)$$

The acquired calibration exhaust velocity Scal(Mest, Q0, θj) is an exhaust velocity depending on the conductance of the vacuum system (the vacuum chamber 5) attached to the APC valve 3. On the other hand, the effective exhaust velocity Se(Mest, Q0, θj) of the initial data unit group GDU2 is an exhaust velocity depending on the conductance of the vacuum system when an effective exhaust velocity Se(Mi, Qk, θj) is acquired in the manufacturer. Thus, α(θj) represented by Expression (9) below is a correction coefficient for correcting the effective exhaust velocity Se(θj) of the initial data unit group GDU2 to the acquired calibration exhaust velocity Scal(θj) of the calibrated data unit group CGDU2. The correction coefficient α(θj) is set according to the opening degree θj of the APC valve 3.

$$\alpha(\theta j)=\mathrm{Scal}(\mathrm{Mest},Q0,\theta j)/Se(\mathrm{Mest},Q0,\theta j) \quad (9)$$

Note that as described with reference to FIG. 7, the pump exhaust velocity is dominant in the range where the opening degree θ is greater than θth, and the valve conductance is dominant in the range where the opening degree θ is smaller than θth. As described above, the correction coefficient α(θj) takes influence of the upstream side of the APC valve 3 into consideration, and such influence is greater at an opening degree of θ>θth at which the pump exhaust velocity is dominant. Thus, upon calculation of the correction coefficient α(θj), the correction coefficient α(θj) may be calculated only for an opening degree range of θ>θth, and α(θj)=1 may be set for an opening degree range of θ≤θth.

The correction coefficient α(θj) of Expression (9) can be also applied to the effective exhaust velocity Se(Mi, Qk, θj) in other cases than a case where the gas type is Mest and the flow rate is Q0. That is, the calibrated effective exhaust velocity Secal(Mi, Qk, θj) of the calibrated data unit group CGDU2 is calculated according to Expression (10) below. Note that i, j, and k are integers satisfying 1≤i, k≤6, and 1≤j≤20.

$$\mathrm{Secal}(Mi,Qk,\theta j)=\alpha(\theta j)\cdot Se(Mi,Qk,\theta j) \quad (10)$$

At a step S90, the calibrated data unit group CGDU1 of the initial data unit group GDU1 is generated based on the calibrated data unit group CGDU2 generated at the step S80. The generated calibrated data unit group CGDU1 is stored in the storage section 42. The reciprocal sensitivity (1/Gp) is represented as in Expression (5) as described above to Expression (11) below. Thus, the calibrated effective exhaust velocity Secal(Mi, Qk, θj) of the calibrated data unit group CGDU2 is applied to the effective exhaust velocity Se of Expression (11), and in this manner, the calibrated reciprocal sensitivity (1/Gp) in the calibrated data unit group CGDU1 can be obtained.

$$1/Gp=Se/|(\Delta Se/\Delta\theta)| \quad (11)$$

At a step S100, the calibrated data unit groups CGDU1, CGDU2 are output to the valve controller 33 of the APC valve 3, and are stored in the storage section 333 of the valve controller 33. In this case, the calibrated data unit groups CGDU1, CGDU2 may be stored separately from the initial data unit groups GDU1, GDU2, or may be stored with the calibrated data unit groups CGDU1, CGDU2 being written over the initial data unit groups GDU1, GDU2.

Note that for the initial data unit group GDU1 for the reciprocal sensitivity (1/Gp), in a case where a difference between the data unit for the reciprocal sensitivity (1/Gp) based on the acquired calibration exhaust velocity Scal (Mest, Q0, θj) and the data unit for the reciprocal sensitivity (1/Gp) based on the effective exhaust velocity Se(Mest, Q0, θj) estimated upon calibration is smaller than a preset threshold, the calibration processing for the reciprocal sensitivity (1/Gp) is not necessarily performed.

(2: M, Q Estimation Upon Pressure Control by First Estimation Section 411)

By the above-described calibration processing, the initial data unit groups GDU1, GDU2 are calibrated into the calibrated data unit groups CGDU1, CGDU2. The valve controller 33 of the APC valve 3 performs the pressure control based on the reciprocal sensitivity (1/Gp) of the calibrated data unit group CGDU1 input from the gas estimator 4. The gas type of gas used upon calibration is different from that in the process. For this reason, upon the pressure control, the gas type in the process needs to be sequentially estimated to perform the pressure control by means of the reciprocal sensitivity (1/Gp) based on the estimated gas type. Thus, in the first estimation section 411 of the control section 41, the gas type and the flow rate, i.e., the pressure control estimation value (Mest2, Qest2), upon the pressure control in the APC valve 3 are estimated.

Figure 17:
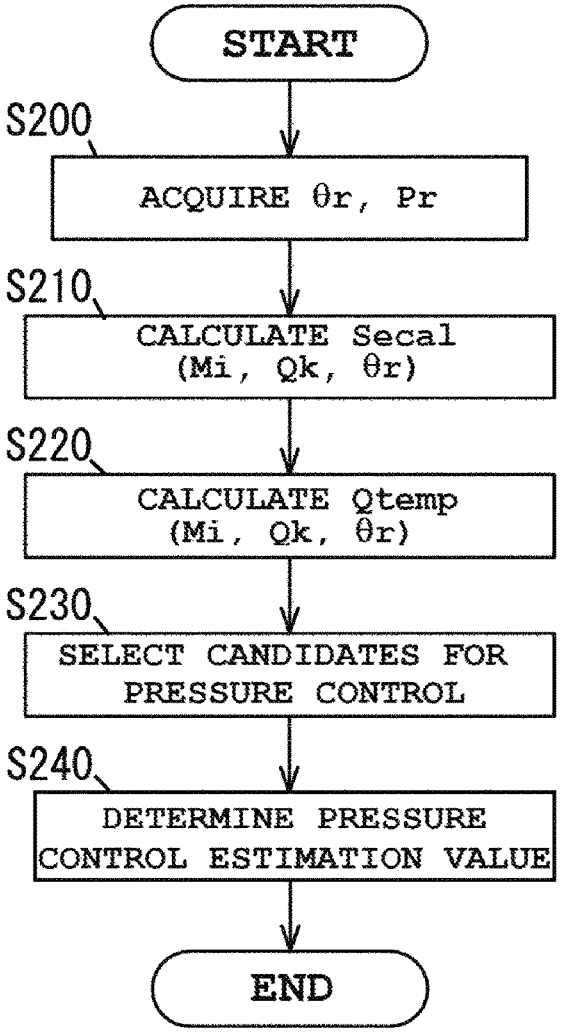
FIG. 17 is a flowchart of one example of estimation processing of a gas type and a flow rate upon pressure control.

FIG. 17 is a flowchart of one example of the processing of estimating the gas type M and the flow rate Q upon the pressure control executed in the control section 41. At a step S200, the opening degree θr is acquired from the encoder 322, and the pressure measurement value Pr is acquired from the vacuum meter 6. At a step S210, the acquired opening degree θr is applied to 36 calibrated data units CDU2 (the Se-θ correlation) included in the calibrated data unit group CGDU2, and the calibrated effective exhaust velocity Secal (Mi, Qk, θr) at the opening degree θr is calculated for 36 groups of (Mi, Qk) (see FIG. 12).

At a step S220, the temporary flow rate Qtemp(Mi, Qk, θr) at each (Mi, Qk) is calculated from the pressure measurement value Pr(θr) acquired at the step S200 and the calibrated effective exhaust velocity Secal(Mi, Qk, θr) calculated at the step S210. Upon the pressure control, the valve plate 311 is constantly in operation, and the opening degree constantly changes. Thus, the valve plate 311 is not always in an equilibrium state. For this reason, the temporary flow rate Qtemp(Mi, Qk, θr) is calculated by Expression (12) below. In Expression (12), V is the volume of the vacuum chamber 5, and the volume V is acquired by, e.g., a build-up method upon calibration. Moreover, Δt is a time interval of a control cycle, and is normally about 1 ms to 10 ms.

$$\mathrm{Qtemp}(Mi,Qk,\theta r)=\mathrm{Secal}(Mi,Qk,\theta r)\times Pr(\theta r)+V\times(\Delta P/\Delta t) \quad (12)$$

In theory, when the substituted Mi, Qk are the same as the gas type M and the flow rate Q actually introduced, a difference between the temporary flow rate Qtemp(Mi, Qk, θr) calculated in Expression (12) and the flow rate Qk is zero. Thus, at a step S230, ones with a smaller difference between the temporary flow rate Qtemp(Mi, Qk, θr) and the flow rate Qk than a threshold (an allowable error) are selected as candidates for the gas type Mest2 and the flow rate Qest2 estimated upon the pressure control. As in the case of the step S50 of FIG. 15 as described above, multiple values (Ma, Qtemp(Ma)), (Mb, Qtemp(Mb)), (Mc, Qtemp (Mc)) smaller than the threshold will be described as the selected candidates.

At a step S240, the estimation value (Mest, Qest) for the gas type M and the flow rate Q upon the pressure control is determined by processing similar to that in the case of the step S70 of FIG. 15. That is, the motor current value I is acquired from the pump controller 22 of the turbo-molecular pump 2, and the flow rates Q(Ma), Q(Mb), Q(Mc) corresponding to the estimation values Ma, Mb, Mc for the gas type M are obtained from the initial data units DU3(I) corresponding to the motor current value I.

Note that upon the pressure control, the flow rate of gas changes due to switching of valve plate operation or the process conditions, and the motor current value Ir also fluctuates. For this reason, one obtained by low-pass processing of the motor current value is preferably used as the motor current value Ir. Further, smoothing processing such as a moving average may be performed for the obtained estimation value (Mest, Qest), thereby mitigating a fluctuation error.

Figure 18:
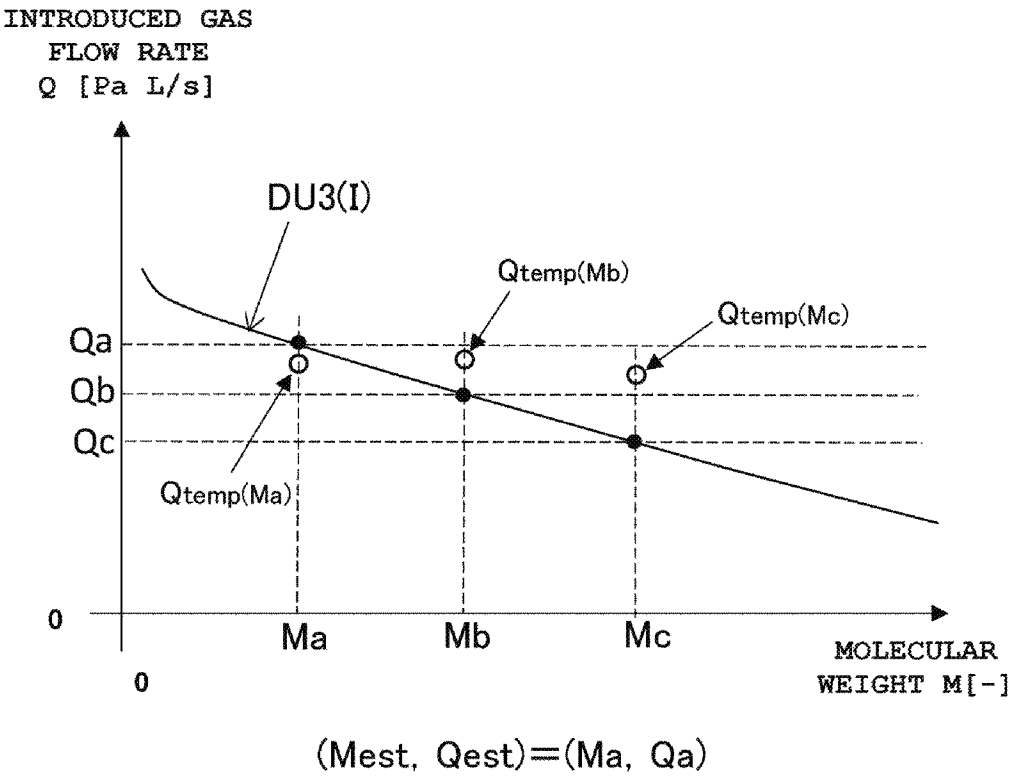
FIG. 18 is a graph of the initial data unit DU3(I) and the temporary flow rate Qtemp.

FIG. 18 is a graph of the line of the initial data unit DU3(I) and the temporary flow rates Qtemp (Ma, Qa, θr), Qtemp (Mb, Qb, θr), Qtemp(Mc, Qc, θr) on the MQ coordinates. Note that in FIG. 18, the temporary flow rates Qtemp (Ma, Qa, θr), Qtemp (Mb, Qb, θr), Qtemp (Mc, Qc, θr) are shown as the temporary flow rates Qtemp(Ma), Qtemp(Mb), Qtemp (Mc). In the case of an example shown in FIG. 18, the temporary flow rate Qtemp(Ma, Qa, θr) is closest to the line indicating the initial data unit DU3(I), and (Ma, Qa) is determined as the pressure control estimation value (Mest2, Qest2). The pressure control estimation value (Mest2, Qest2) estimated in the first estimation section 411 of the control section 41 is input to the valve controller 33 and the pump controller 22.

Figure 19:
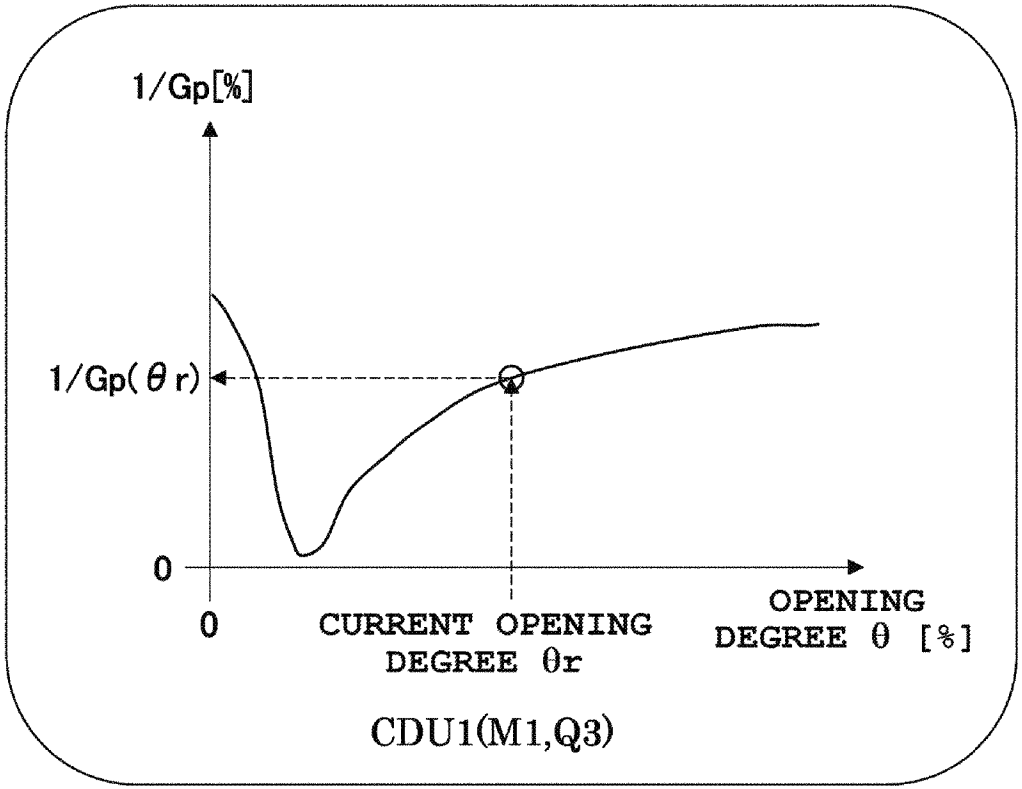
FIG. 19 is a graph of a calibrated data unit CDU1 (M1, Q3)

The estimation processing shown in FIG. 17 is sequentially executed in synchronization with the control time interval of the pressure control in the control section 331 of the valve controller 33. The control section 331 of the valve controller 33 reads, from the storage section 333, the reciprocal sensitivity (1/Gp) corresponding to the pressure control estimation value (Mest2, Qest2) input from the gas estimator 4 and the opening degree θr input from the encoder 322. For example, in a case where the pressure control estimation value (Mest2, Qest2) is (M1, Q3), the calibrated data unit CDU1(M1, Q3) shown in FIG. 19 is selected from the calibrated data unit group CGDU1. Then, the control section 331 selects the data 1/Gp(θr) for the current opening degree θr from the calibrated data unit CDU1(M1, Q3), and the pressure control is performed using the reciprocal sensitivity 1/Gp(θr).

Note that in the estimation processing shown in FIG. 17, the gas type Mest2 and the flow rate Qest2 upon the pressure control are estimated using the calibrated data unit group CGDU2, but the estimation processing may be performed using the initial data unit group GDU2. For example, in the case of not performing initial calibration, the calibrated data unit group CGDU2 is not generated, and therefore, the initial data unit group GDU2 is used for the estimation processing. The calibration processing is for correcting a difference between the conductance of the vacuum chamber when the initial data unit group GDU2 is acquired and the conductance of the vacuum chamber 5 of the vacuum processing device. In the case of a small difference between these conductances, the difference between the calibration estimation value (Mest, Qest) is also small, so that the initial data unit group GDU2 can be used instead of the calibrated data unit group CGDU2.

The following variations are within the scope of the present invention, and one or more of the variations may be combined with the above-described embodiment.

(First Variation)

In the first variation, one example of calculation load reduction of the gas estimator 4 will be described. Considering greater gas type dependency of the reciprocal sensitivity (1/Gp) than that of the flow rate, the flow rate may be fixed to a representative flow rate in advance, and the data unit for the effective exhaust velocity Se and the data unit for the reciprocal sensitivity (1/Gp) may be formed using only the gas type as a parameter. Further, three gas type parameters are provided, and selection is made from these three parameters.

For example, a single type of 200 sccm is provided as the flow rate, $H_2$ (M=2) is selected as the lightest gas, He (M=4) is selected as a representative of intermediate gases He to $N_2$ (M=4 to 28), and Ar (M=40) is selected as a representative of heavy gases Ar to Xe (M=40 or more). The parameters are reduced as described above so that a calculation load can be reduced when the estimation value (Mest, Qest) is obtained.

(Second Variation)

In the above-described embodiment, it is configured such that the gas estimator 4 is provided separately from the pump controller 22 and the valve controller 33 as illustrated in FIG. 1, but the gas estimator 4 may be incorporated in the valve controller 33 or the pump controller 22. In the case of incorporating the gas estimator 4 in the valve controller 33, data on the pressure control estimation value (Mest2, Qest2) and the motor current value Ir is transmitted/received between the valve controller 33 and the pump controller 22. In the case of incorporating the gas estimator 4 in the pump controller 22, the pressure control estimation value (Mest2, Qest2) and the motor current value Ir are transmitted from the pump controller 22 to the valve controller 33.

(Third Variation)

FIGS. 9A and 9B as described above shows the difference tendency of the plant gain Gp according to the gas type. As shown in FIGS. 9A and 9B, the opening degree θ_Gp_max with the maximum plant gain Gp is at the substantially same position even in the case of different gas types. Such characteristics are also characteristics for mitigating the gas type dependency. For example, in a case where the process conditions change within a significantly short time and great pressure fluctuation is constantly shown, estimation of the gas type and the gas flow rate upon the pressure control described above is not easy. In this case, considering an adverse effect in the case of inaccurate estimation of the gas type and the gas flow rate upon the pressure control, a Gp aspect weak in the gas type dependency is utilized if not providing the above-described effect of improving controllability. Of the calibrated plant gain data (the reciprocal sensitivity (1/Gp) of the calibrated data unit group CGDU) obtained in initial calibration, the plant gain data under certain preset gas type conditions is transmitted from the gas estimator 4 to the valve controller 33 of the APC valve 3. The valve controller 33 constantly applies such certain data to set the gain in the pressure control regardless of the process conditions (the gas type).

Second Embodiment

In the above-described first embodiment, the pressure control of the APC valve 3 is performed based on the pressure control estimation value (Mest2, Qest2) of the gas estimator 4. In a second embodiment, a control section 221 of a turbo-molecular pump 2 performs, based on a pressure control estimation value (Mest2, Qest2) input from a gas estimator 4, preventive maintenance operation for the turbo-molecular pump 2 provided at a vacuum pumping device 1 of FIG. 1.

Figure 20:
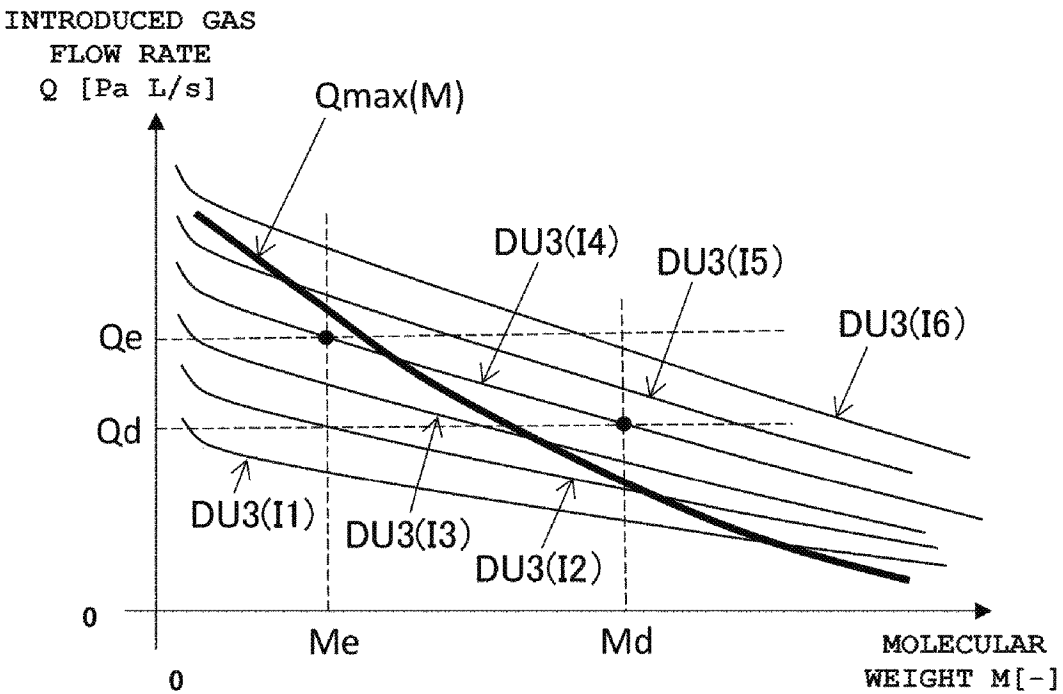
FIG. 20 is a graph of one example of allowable flow rate data Qmax (M)

For the turbo-molecular pump 2, an allowable upper flow rate limit for exhausting for each gas type M is set. FIG. 20 is a graph of one example of allowable flow rate data Qmax(M) regarding the allowable upper flow rate limit. The allowable flow rate data Qmax(M) is stored in a storage section 223 of a pump controller 22. A greater flow rate of gas results in a higher temperature of a pump rotor due to heat generation in association with exhausting. However, an excessive increase in the temperature leads to shortening of a rotor life. For this reason, in the turbo-molecular pump 2, the allowable flow rate data Qmax(M) as shown in FIG. 20 is set as the upper flow rate limit for preventing shortening of the rotor life.

An example shown in FIG. 20 shows a line of the allowable flow rate data Qmax(M) on initial data units DU3(I1) to DU3(I6) shown in FIG. 13. For example, in the case of a gas type (molecular weight) Me with a small molecular weight, even a flow rate Qe falls below an allowable upper flow rate limit Qmax(Me). However, in the case of a gas type Md(>Me) with a great molecular weight, even a flow rate Qd smaller than the flow rate Qe exceeds an allowable upper flow rate limit Qmax(Md).

Figure 21:
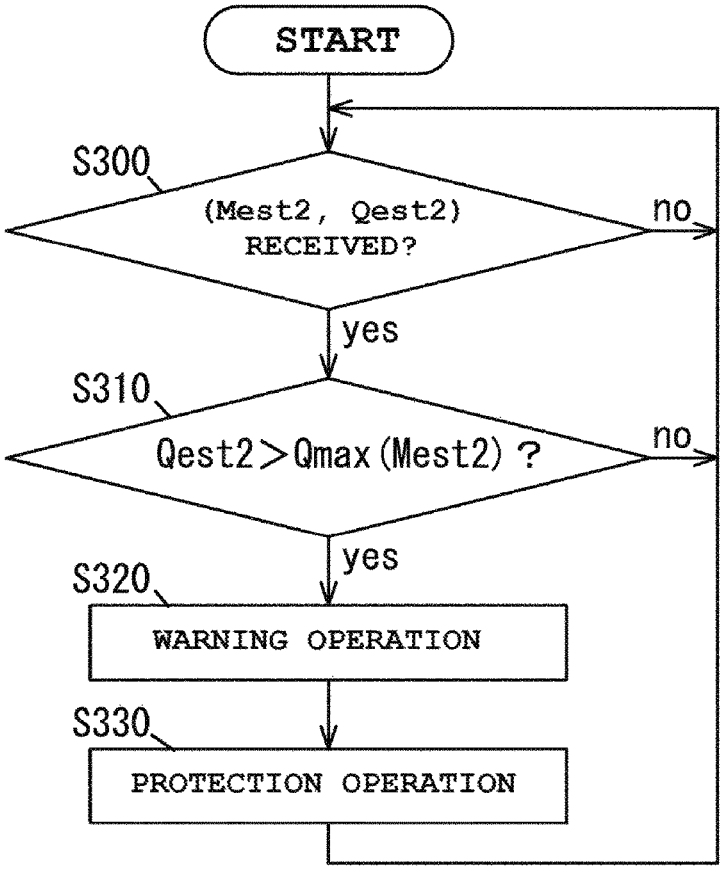
FIG. 21 is a flowchart of one example of preventive maintenance processing.

In the second embodiment, the control section 221 of the pump controller 22 executes preventive maintenance processing as shown in FIG. 21 based on the pressure control estimation value (Mest2, Qest2) input from the gas estimator 4. FIG. 21 is a flowchart of one example of the preventive maintenance processing. A series of processing shown in FIG. 21 starts when rotary driving of the turbo-molecular pump 2 is started, and ends when such rotary driving is stopped.

At a step S300, it is determined whether or not the pressure control estimation value (Mest2, Qest2) from the gas estimator 4 has been received. When received, the processing proceeds to a step S310.

At the step S310, the estimated flow rate Qest2 and an allowable upper flow rate limit Qmax(Mest2) at the gas type Mest2 are compared with each other, and it is determined whether or not the flow rate Qest exceeds the allowable upper flow rate limit Qmax(Mest2), i.e., Qest2>Qmax (Mest2) is satisfied. In a case where it is determined as Qest2≤Qmax(Mest2) at the step S310, the processing returns to the step S300.

On the other hand, it is determined as Qest2>Qmax (Mest2) at the step S310, the processing proceeds to a step S320 to execute warning operation. As an example of the warning operation, a warning signal may be output from the pump controller 22 to the gas estimator 4, and a warning screen may be displayed on a display section 43. Alternatively, a warning signal may be output to a higher-order controller of the vacuum pumping device 1.

At a step S330, protection operation for preventing shortening of the life of the pump rotor is executed, and the processing returns to the step S300. For example, the rotor rotation speed of the turbo-molecular pump is decreased or rotor rotation is stopped such that a gas load on the turbo-molecular pump 2 is reduced. Thus, an increase in the temperature of the pump rotor can be suppressed, and therefore, shortening of the life of the pump rotor can be suppressed. Moreover, a protection operation signal for decreasing the gas flow rate may be output to the higher-order controller on a vacuum processing device side provided with the vacuum pumping device 1, and in this manner, the gas load on the turbo-molecular pump 2 may be reduced.

Note that in the second embodiment, the first to third variations described in the first embodiment are also applicable.

According to the above-described embodiments, the following features and advantageous effects are obtained.

(C1) As illustrated in FIGS. 1, 6, and 10, the gas estimator 4 includes the storage section 42 configured to store the first correlation data containing the initial data unit group GDU1 as the correlation data regarding the opening degree control gain 1/Gp of the APC valve 3 and the initial data unit group GDU2 as the correlation data regarding the effective exhaust velocity Se of the vacuum pumping device 1 and the second correlation data as the initial data unit group GDU3 indicating the correlation among the flow rate Q, the gas type M, and the motor current value I in the turbo-molecular pump 2, and the first estimation section configured to estimate the flow rate and gas type of gas to be vacuum-pumped by the vacuum pumping device 1 based on at least the first correlation data and the second correlation data. The gas estimator 4 outputs control correction information used for the control of the APC valve 3 based on the estimation result of the first estimation section.

The control correction information based on the estimation result of the first estimation section is information based on the gas type, and therefore, the pressure control of the APC valve 3 can be, with higher accuracy, performed by means of the control correction information. Note that the first estimation section configured to estimate the flow rate and gas type of gas to be vacuum-pumped by the vacuum pumping device 1 based on at least the first correlation data and the second correlation data corresponds to the first estimation section 411 or the second estimation section 412 of FIG. 10. As described later, the control correction information in the case of the first estimation section 411 is the flow rate Qest2 and the gas type Mest2, and the control correction information in the case of the second estimation section 412 is the calibrated data unit groups CGDU1, CGDU2.

(C2) In a case where the first estimation section in (C1) as described above corresponds to the first estimation section 411 of FIG. 10, the first estimation section 411 estimates the flow rate Qest2 and the gas type Mest2 of gas to be vacuum-pumped by the vacuum pumping device 1 based on the motor current value Ir of the turbo-molecular pump 2, the opening degree θ of the APC valve 3, the pressure measurement value Pr of the vacuum chamber 5 vacuum-pumped by the vacuum pumping device 1, the first correlation data, and the second correlation data, and the flow rate Qest2 and the gas type Mest2 as the estimation result of the first estimation section 411 are output as the above-described control correction information.

The APC valve 3 utilizes the estimation result (the flow rate Qest2 and the gas type Mest2) output by the gas estimator 4 so that the pressure control can be performed with higher accuracy.

(C3) The gas estimator 4 may further include the second estimation section 412 configured to estimate the flow rate Qest and the gas type Mest of gas to be vacuum-pumped by the vacuum pumping device 1 based on the pressure measurement value Pr for each of the multiple valve opening degrees θ1 to θ20 upon gas exhausting with the predetermined flow rate Q0, the opening degrees θ1 to θ20, the motor current value Ir of the vacuum pump (the turbo-molecular pump 2), the first correlation data (the initial data unit groups GDU1, GDU2), and the second correlation data (the initial data unit group GDU3), and the calibration section 413 configured to calibrate the first correlation data (the initial data unit groups GDU1, GDU2) based on the gas type Mest estimated by the second estimation section 412. The pre-calibration first correlation data (the initial data unit groups GDU1, GDU2) stored in the storage section 42 may be replaced with the first correlation data (the calibrated data unit groups CGDU1, CGDU2) calibrated by the calibration section 413.

As described above, estimation of the flow rate Qest2 and the gas type Mest2 by the first estimation section 411 as described above is performed using the first correlation data calibrated by the calibration section 413. In this manner, the accuracy of estimation of the pressure control estimation value (Mest2, Qest2) can be improved, and the accuracy of the pressure control can be further improved. Note that the gas type in initial calibration is unknown for the gas estimator 4. However, the gas type Mest is estimated by the second estimation section 412 as described above so that calibration in the calibration section 413 can be performed with higher accuracy.

(C4) The determination section 414 determines, based on the flow rate Qest estimated by the second estimation section 412, whether or not the flow rate upon pressure measurement for each of the multiple valve opening degrees is the predetermined flow rate Q0. By such determination, it can be, upon calibration, determined whether the flow rate of inflow gas is proper. Thus, the determination result is reflected in the calibration processing as in the flowchart of FIG. 15 so that the proper calibration processing can be reliably executed.

(C5) In a case where the flow rate Qest2 and the gas type Mest2 output from the first estimation section 411 are applied to the pressure control of the APC valve 3 of the vacuum pumping device 1, the reciprocal sensitivity (1/Gp) as the gain value upon the pressure control is, in the gain value setting section 340, set based on the flow rate Qest2 and the gas type Mest2 estimated by the first estimation section 411, the opening degree θr measured by the encoder 322, and the gain data (the calibrated data unit group CGDU1) as illustrated in FIG. 6. Then, the control section 331 of the APC valve 3 controls the valve opening degree θ based on the set gain value and the pressure measurement value Pr. As a result, the pressure control of the APC valve 3 can be performed with higher accuracy.

(C6) In a case where the flow rate Qest2 and the gas type Mest2 output from the first estimation section 411 are applied to the vacuum pump (the turbo-molecular pump 2) of the vacuum pumping device 1, if the flow rate Qest2 estimated by the first estimation section 411 is greater than the allowable upper flow rate limit Qmax (Mest2) acquired based on the allowable flow rate data Qmax(M) and the gas type Mest2 estimated by the first estimation section 411, warning information is output from the control section 221 of the pump controller 22. As a result, the procedure for preventing shortening of the life of the pump rotor can be promptly taken based on the warning information. Moreover, the warning information regarding the life is transmitted to the higher-order controller on the vacuum processing device side so that the life management procedure can be more precisely performed.

(C7) In a case where the first estimation section in (C1) as described above corresponds to the second estimation section 412 of FIG. 10, the second estimation section 412 estimates, as in the above-described third variation, the flow rate Qest and the gas type Mest of gas to be vacuum-pumped by the vacuum pumping device 1 based on the pressure measurement value Pr for each of the multiple valve opening degrees θ1 to θ20 upon gas exhausting with the predetermined flow rate Q0, the opening degrees θ1 to θ20, the motor current value Ir of the vacuum pump (the turbo-molecular pump 2), the first correlation data (the initial data unit groups GDU1, GDU2), and the second correlation data (the initial data unit group GDU3). The calibration section 413 calibrates the first correlation data (the initial data unit groups GDU1, GDU2) based on the gas type Mest estimated by the second estimation section 412. The calibrated first correlation data (the calibrated data unit groups CGDU1, CGDU2) calibrated by the calibration section 413 is output to the outside of the gas estimator 4.

The APC valve 3 uses the calibrated first correlation data (the calibrated data unit groups CGDU1, CGDU2) output from the gas estimator 4 so that the opening degree control can be performed with higher accuracy.

(C8) For example, the gain value setting section 340 of FIG. 6 sets the gain value 1/Gp (θr) of the valve opening degree control upon the pressure control based on the preset gas type, the valve opening degree measurement value θr, and the calibrated first correlation data (the calibrated data unit groups CGDU1, CGDU2). Then, the valve opening degree is controlled based on the set gain value 1/Gp (θr) and the pressure measurement value Pr.

As illustrated in FIGS. 9A and 9B, the opening degree 0_Gp_max with the maximum plant gain Gp is at the substantially same position even for different gas types. This shows weak gas type dependency of the plant gain Gp. Using such dependency, the certain gas type is assumed as gas of which gas type is unknown in the middle of the process. Using the reciprocal sensitivity (1/Gp) based on such certain gas type conditions and the calibrated data unit group CGDU1, the accuracy of the valve opening degree control can be improved.

Various embodiments and the variations have been described above, but the present invention is not limited to these contents. Other aspects conceivable within the scope of the technical idea of the present invention are also included in the scope of the present invention. For example, the case of using the turbo-molecular pump 2 as the vacuum pump connected to the APC valve 3 has been described as an example, but the vacuum pump is not limited to the turbo-molecular pump. Moreover, the APC valve is the valve employing the technique of swingably driving the valve plate, but is not limited to such a technique.

1 vacuum pumping device
2 turbo-molecular pump
3 automatic pressure control valve
4 gas estimator
5 vacuum chamber
6 vacuum meter
41, 221, 331 control section
42, 223, 333 storage section
322 encoder
340 gain value setting section
411 first estimation section
412 second estimation section
413 calibration section
414 determination section
GUD1 to GUD3 initial data unit group
CGUD1 to CGUD2 calibrated data unit group

What is claimed is:

1. A gas estimation device for estimating a flow rate and a gas type of gas to be vacuum-pumped by a vacuum pumping device including a vacuum pump and an automatic pressure control valve connected to a suction port of the vacuum pump, comprising:

a data storage comprising a non-transitory computer readable medium that is configured to store first correlation data containing correlation data regarding an opening degree control gain value of the automatic pressure control valve and correlation data regarding an effective exhaust velocity of the vacuum pumping device and second correlation data indicating a correlation among a flow rate, a gas type, and a motor current value in the vacuum pump; and a controller configured to estimate the flow rate and the gas type of the gas to be vacuum-pumped by the vacuum pumping device based on at least the first correlation data and the second correlation data, wherein the correlation data regarding the opening degree control gain value indicates a correlation among the opening degree control gain value, the gas type and the flow rate of the gas to be vacuum-pumped by the vacuum pumping device, and a valve opening degree of the automatic pressure control valve, the correlation data regarding the effective exhaust velocity indicates a correlation among the effective exhaust velocity, the gas type and the flow rate of the gas to be vacuum-pumped by the vacuum pumping device, and the valve opening degree of the automatic pressure control valve, and control correction information used for control of the automatic pressure control valve is output based on an estimation result of the controller.

2. The gas estimation device according to claim 1, wherein the controller estimates the flow rate and the gas type of the gas to be vacuum-pumped by the vacuum pumping device based on the motor current value of the vacuum pump, the valve opening degree of the automatic pressure control valve, a pressure measurement value of a vacuum chamber vacuum-pumped by the vacuum pumping device, the first correlation data, and the second correlation data, and the estimation result of the controller is output as the control correction information.

3. The gas estimation device according to claim 2, wherein the controller is further configured to:

estimate the flow rate and the gas type of the gas to be vacuum-pumped by the vacuum pumping device based on a pressure measurement value for each of multiple valve opening degrees upon gas exhausting with a predetermined flow rate, the multiple valve opening degrees, the motor current value of the vacuum pump, the first correlation data, and the second correlation data; and calibrate the first correlation data based on the estimated gas type, wherein pre-calibration first correlation data stored in the data storage is replaced with the calibrated first correlation data.

4. The gas estimation device according to claim 3, wherein the controller is further configured to:

determine, based on the estimated flow rate, whether or not a flow rate upon pressure measurement for each of the multiple valve opening degrees is the predetermined flow rate.

5. A vacuum pumping device comprising:

the gas estimation device according to claim 2;

a vacuum pump; and an automatic pressure control valve connected to a suction port side of the vacuum pump, wherein the automatic pressure control valve is configured to:

measure the valve opening degree, set a gain value of valve opening degree control upon pressure control based on the flow rate and the estimated gas type, a valve opening degree measurement value, and the first correlation data stored in the data storage, and control the valve opening based on the set gain value and the pressure measurement value.

6. A vacuum pumping device comprising:

the gas estimation device according to claim 2;

a vacuum pump; and an automatic pressure control valve connected to a suction port side of the vacuum pump, wherein the vacuum pump is configured to:

store allowable flow rate data indicating a correlation between a gas type of gas to be exhausted by the vacuum pump and an allowable upper flow rate limit, and output warning information in a case where the estimated flow rate is greater than the allowable upper flow rate limit acquired based on the allowable flow rate data and the estimated gas type.

7. The gas estimation device according to claim 1, wherein the controller estimates the flow rate and the gas type of the gas to be vacuum-pumped by the vacuum pumping device based on a pressure measurement value for each of multiple valve opening degrees upon gas exhausting with a predetermined flow rate, the multiple valve opening degrees, the motor current value of the vacuum pump, the first correlation data, and the second correlation data, the controller is further configured to calibrate the first correlation data based on the estimated gas type, and the calibrated first correlation data is output as the control correction information.

8. A vacuum pumping device comprising:

the gas estimation device according to claim 7;

a vacuum pump; and an automatic pressure control valve connected to a suction port side of the vacuum pump, wherein the automatic pressure control valve is configured to:

measure the valve opening degree, set a gain value of valve opening degree control upon pressure control based on a preset gas type, a valve opening degree measurement value, and the calibrated first correlation data, and control the valve opening degree based on the set gain value and the pressure measurement value.

* * * * *